US010494865B2

(12) United States Patent
Valdez Ontiveros et al.

(10) Patent No.: US 10,494,865 B2
(45) Date of Patent: Dec. 3, 2019

(54) CABLE TRAP SYSTEM AND METHOD

(71) Applicant: LOUISVILLE LADDER INC., Louisville, KY (US)

(72) Inventors: Victor Hugo Valdez Ontiveros, Nuevo León C.P. (MX); Andres Eduardo Reyes Acosta, Nuevo León C.P. (MX)

(73) Assignee: Louisville Ladder Inc., Louisville, KY (US)

( * ) Notice: Subject to any disclaimer, the term of this patent is extended or adjusted under 35 U.S.C. 154(b) by 0 days.

(21) Appl. No.: 15/688,726

(22) Filed: Aug. 28, 2017

(65) Prior Publication Data

US 2019/0063152 A1 Feb. 28, 2019

(51) Int. Cl.

| | |
|---|---|
| ***E06C 1/36*** | (2006.01) |
| ***E06C 1/34*** | (2006.01) |
| ***E06C 7/18*** | (2006.01) |
| ***E06C 7/48*** | (2006.01) |

(52) U.S. Cl.

CPC ..... *E06C 1/36* (2013.01); *E06C 1/34* (2013.01); *E06C 7/188* (2013.01); *E06C 7/48* (2013.01)

(58) Field of Classification Search

CPC ..... E04G 1/36; E06C 1/36; E06C 1/34; E06C 7/48

See application file for complete search history.

(56) References Cited

U.S. PATENT DOCUMENTS 2,140,828 A * 12/1938 Carle ..... E06C 1/36 182/122
2,439,430 A * 4/1948 Hurd ..... E06C 1/36 182/206
3,061,041 A * 10/1962 Taylor ..... E04D 13/064 182/129
3,780,829 A * 12/1973 Wallingford ..... E06C 1/36 182/206
D290,931 S 7/1987 Powell
(Continued)

FOREIGN PATENT DOCUMENTS

CA 2 883 793 A1 4/2014

OTHER PUBLICATIONS

Examiner's Report, U.S. Pat. No. 2,978,854, dated Nov. 19, 2018.

*Primary Examiner* — Colleen M Chavchavadze

(74) *Attorney, Agent, or Firm* — Orrick, Herrington & Sutcliffe LLP

(57) ABSTRACT

A safety apparatus for coupling with a ladder and methods for manufacturing and using same. The safety apparatus includes an engagement member defining an engagement member recess for receiving a selected structure and a retention member rotatable relative to the engagement member such that the retention member extends distally from the engagement member in an open position and extends proximally to the engagement member in a closed position. The retention member transitions from the open position to the closed position for enclosing the selected structure within the engagement member recess when weight is applied to the ladder and transitions from the closed position to the open position for releasing the selected structure when the weight is removed from the ladder. The ladder advantageously can inhibit unexpectedly detachment from the selected structure during use and does not require manual disengagement of the selected structure after use is complete.

16 Claims, 21 Drawing Sheets

(56) References Cited

U.S. PATENT DOCUMENTS

| | | | | | |
|---|---|---|---|---|---|
| D307,384 | S | | 4/1990 | Phillips | |
| 5,054,581 | A | * | 10/1991 | Henson | E06C 1/36 182/206 |
| D351,334 | S | | 10/1994 | Sachs | |
| 6,044,930 | A | * | 4/2000 | Hayman | E06C 1/34 182/107 |
| 6,158,549 | A | * | 12/2000 | Hartman, Jr. | E06C 1/36 182/206 |
| 7,219,766 | B2 | | 5/2007 | Deuer | |
| D549,356 | S | | 8/2007 | Gibson | |
| D615,725 | S | | 5/2010 | Phillips | |
| 7,753,170 | B1 | | 7/2010 | Gibson | |
| 9,382,759 | B2 | | 7/2016 | Bolinski et al. | |
| 9,404,306 | B2 | | 8/2016 | Russell et al. | |
| 9,567,804 | B2 | * | 2/2017 | Youlyahshiev | E06C 1/36 |
| 9,593,531 | B2 | | 3/2017 | Ballard et al. | |
| 9,988,842 | B2 | * | 6/2018 | Moss | E06C 7/48 |
| 2005/0284703 | A1 | | 12/2005 | Deuer | |
| 2014/0367194 | A1 | | 12/2014 | Bolinski et al. | |
| 2017/0030142 | A1 | | 2/2017 | Russell et al. | |

* cited by examiner

CABLE TRAP SYSTEM AND METHOD

FIELD

The disclosed embodiments relate generally to safety systems and more particularly, but not exclusively, to fall prevention systems suitable for installation on ladders and other elevated platforms.

BACKGROUND

Falls are a leading cause of injuries and effect millions of people every year. Many of these falls involve use of a ladder. Despite being considered basic tools, ladders are inherently dangerous. Some people may discount the dangerous nature of the ladders and thus can fall and suffer serious injuries, or even death. To help prevent falls, some extension ladders include cable hooks or other safety systems for stabilizing the ladders. Cable hooks, for example, can couple the ladder with a telephone cable, power line or the like, that is stretched in space. A cable hook, however, can unexpectedly detach from the cable during use of the ladder and result in a fall. To prevent such detachments, some conventional cable hooks include an adjacent latch for retaining the cable within the cable hook but require a rope to extend the length of the ladder for remotely opening the latch to manually release the cable after use of the ladder.

In view of the foregoing, a need exists for an improved safety system and method for preventing falls from ladders and other elevated platforms that overcome the aforementioned obstacles and deficiencies of currently-available ladder safety systems.

Figure 1:
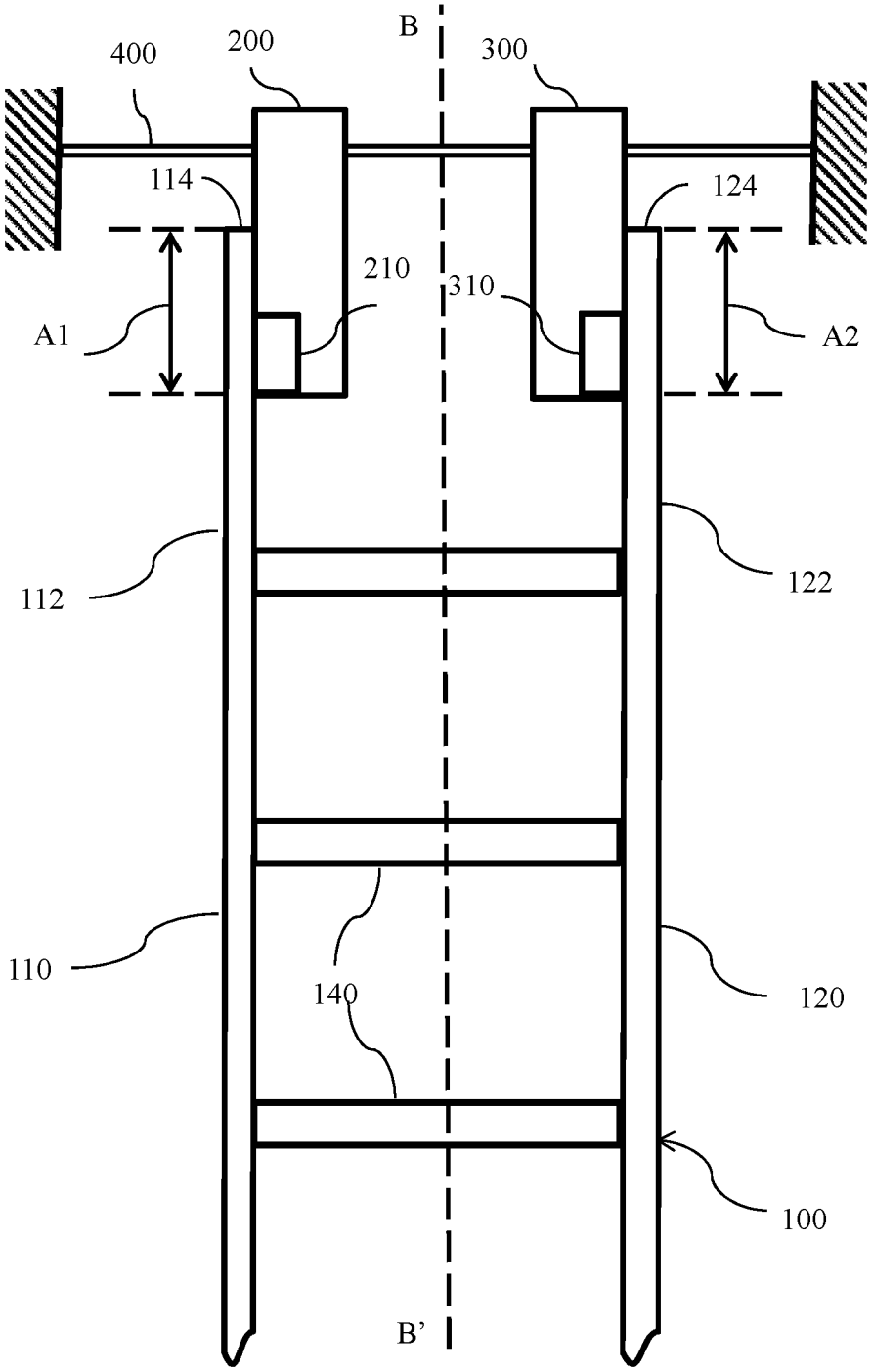
FIG. 1 is an exemplary top-level block diagram illustrating a ladder having a first safety apparatus disposed thereon.

It should be noted that the figures are not drawn to scale and that elements of similar structures or functions are generally represented by like reference numerals for illustrative purposes throughout the figures. It also should be noted that the figures are only intended to facilitate the description of the preferred embodiments. The figures do not illustrate every aspect of the described embodiments and do not limit the scope of the present disclosure.

DETAILED DESCRIPTION OF THE PREFERRED EMBODIMENTS

Since currently-available ladder safety systems can unexpectedly detach during use of the ladder and must be manually actuated after use of the ladder is completed, a safety system and method for preventing falls from ladders and other elevated platforms can prove desirable and provide a basis for a wide range of applications, such as extension ladders. This result can be achieved, according to one embodiment disclosed herein, by a ladder 100 as illustrated in FIG. 1.

The ladder 100 in FIG. 1 can comprise any type of conventional ladder. Exemplary types of ladders can include a step ladder, an extension ladder, a platform ladder, a step stool, a multipurpose ladder, a telescoping ladder, a folding ladder or any other conventional type of ladder without limitation. The ladder 100 of FIG. 1 includes first and second side rails 110, 120 separated by a predetermined distance. The first and second side rails 110, 120 have upper side rail portions 112, 122, respectively. When the ladder 100 is in use, the first and second side rails 110, 120 can be positioned relative to the ground at a selected angle (not shown) such that the upper side rail portions 112, 122 can be positioned distally to the ground. The upper side rail portion 112 includes an upper end region 114 where the first side rail 110 terminates. The upper side rail portion 112 includes an upper end region 124 where the second side rail 120 terminates.

The ladder 100 of FIG. 1 includes a plurality of rungs (also referred to as cross-members or cross pieces) 140 coupling the first and second side rails 110, 120. FIG. 1 shows the ladder 100 as including first and second safety apparatuses 200, 300. The first and second safety apparatuses 200, 300 preferably are disposed adjacent to the upper end regions 114 of the ladder 200.

The first safety apparatus 200 includes a first mounting bracket (also referred to as first ladder mounting bracket) 210 for coupling with the first upper side rail portion 112 of the first side rail 110 at a first predetermined distance A1 from the upper end region 114 of the first side rail 110. The second safety apparatus includes a second mounting bracket (also referred to as second ladder mounting bracket) 310 for coupling with the upper side rail portion 122 of the second side rail 120 at a second predetermined distance A2 from the upper end region 124 of the second side rail 120. As illustratively shown in FIG. 1, the second predetermined distance A2 can be equal to the first predetermined distance A1.

FIG. 1 shows the ladder 100 as being attached to a selected structure 400. The selected structure 400 can include any object that can be engaged with the first and/or second safety apparatuses 200, 300 such that the ladder 100 can be at least partially stabilized by the selected structure 400 during use. An exemplary selected structure 400 can include a wire, cord or other type of cable, such as an overhead cable, a utility line, a cable or wire used for telephone, a cable or wire used for cable television, a power line, a safety cable or the like.

According to the first and second safety apparatuses 200, 300 in various embodiments in the present disclosure, the engagement of a selected structure 400 by the first and second safety apparatuses 200, 300 can increase as weight is added to the ladder 100. The engagement of the selected structure 400 by the first and second safety apparatuses 200, 300 can decrease as the weight is removed from the ladder 100.

In one example, the second safety apparatus 300 can be in mirror symmetry with the first safety apparatus 200. Stated somewhat differently, structures of the first and second apparatuses 200, 300 can be uniform. Advantageously, the ladder 100 can be symmetrically engaged with the selected structure 400 and stability of the ladder 100 during use can be improved. In another example, the second safety apparatus 300 is not in mirror symmetry with the first safety apparatus 200. Stated somewhat differently, structure of the second safety apparatus 300 can be different from structure of the first safety apparatus 200.

The ladder 100 of FIG. 1 can be configured to engage the selected structure 400 at the onset of use and can maintain the engagement with the selected structure 400 while the ladder 100 remains in use. In one embodiment, the ladder 100 can automatically engage the selected structure 400 when use of the ladder 100 is initiated and/or can automatically disengage the selected structure 400 when use of the ladder 100 is complete. The ladder 100 advantageously can inhibit unexpectedly detachment from the selected structure 400 during use and does not require manual disengagement of the selected structure 400 after use is completed.

Figure 2:
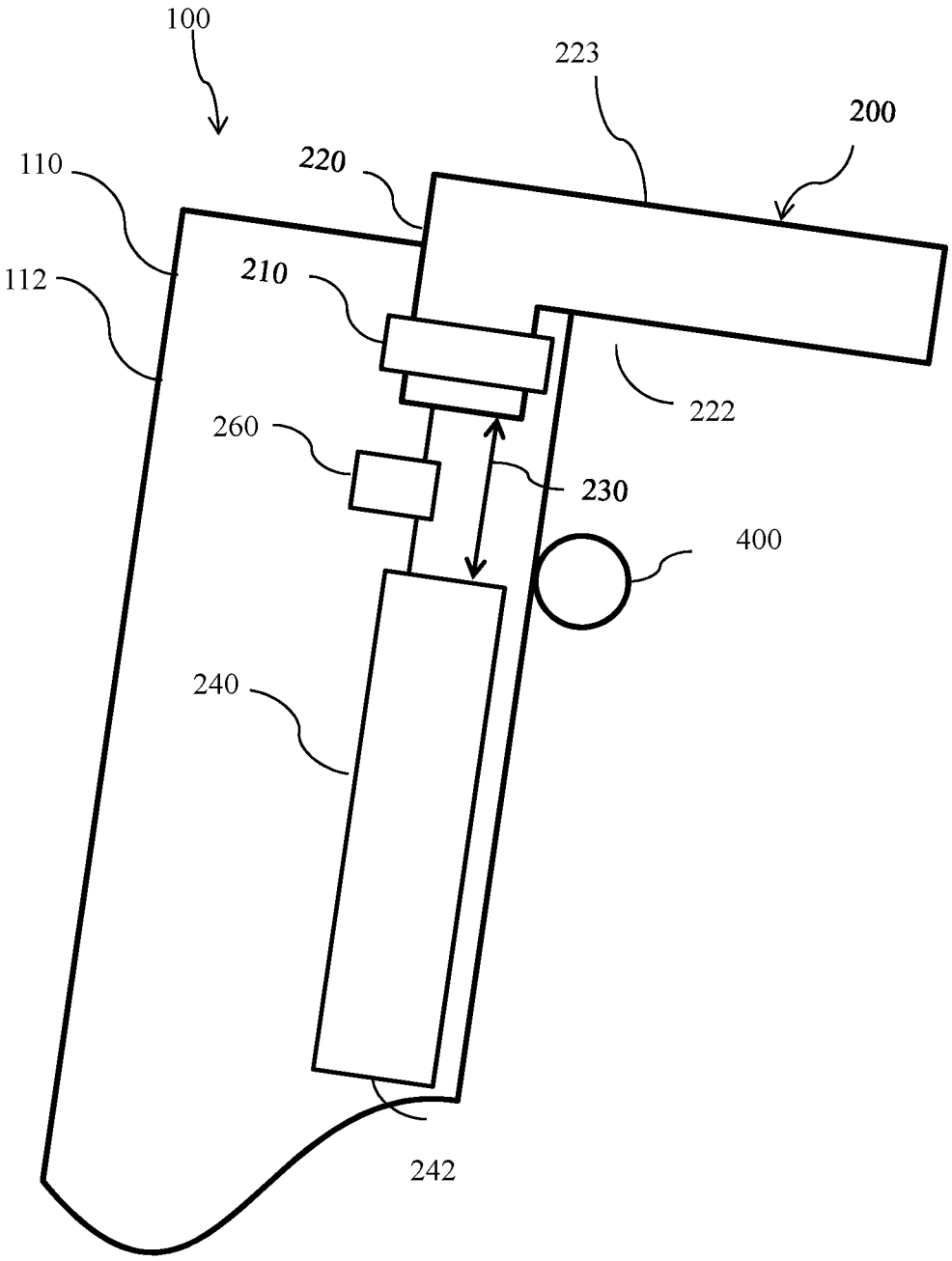
FIG. 2 is an exemplary top-level block diagram illustrating an embodiment of the first safety apparatus of FIG. 1, wherein the first safety apparatus is in an open position.

FIG. 2 shows the first safety apparatus 200 in a cross-sectional view of the ladder 100 in a plane indicated by line BB' (shown in FIG. 1) and perpendicular to the rungs 140 (shown in FIG. 1). FIG. 2 shows the first safety apparatus 200 as including the first mounting bracket 210 for coupling with the first side rail 110 of the ladder 100. The first safety apparatus 200 includes an engagement member 220 slidably engaging the first mounting bracket 210.

The engagement member 220 can include an engagement member portion 223 for defining an engagement member recess 222 for receiving the selected structure 400. Stated somewhat differently, the engagement member portion 223, in cooperation with the upper side rail portion 112 of the first side rail 110, can form the engagement member recess 222.

FIG. 2 shows the first safety apparatus 200 as including a retention member (also referred to as cable trap) 240. The retention member 240 can have an end region (also referred to as cable trap end region) 242 being rotatable relative to the engagement member 220 such that the retention member 240 can extend distally from the engagement member 220 in an open position. In the open position, the selected structure 400 can freely enter and exit from the engagement member recess 222.

Figure 4:
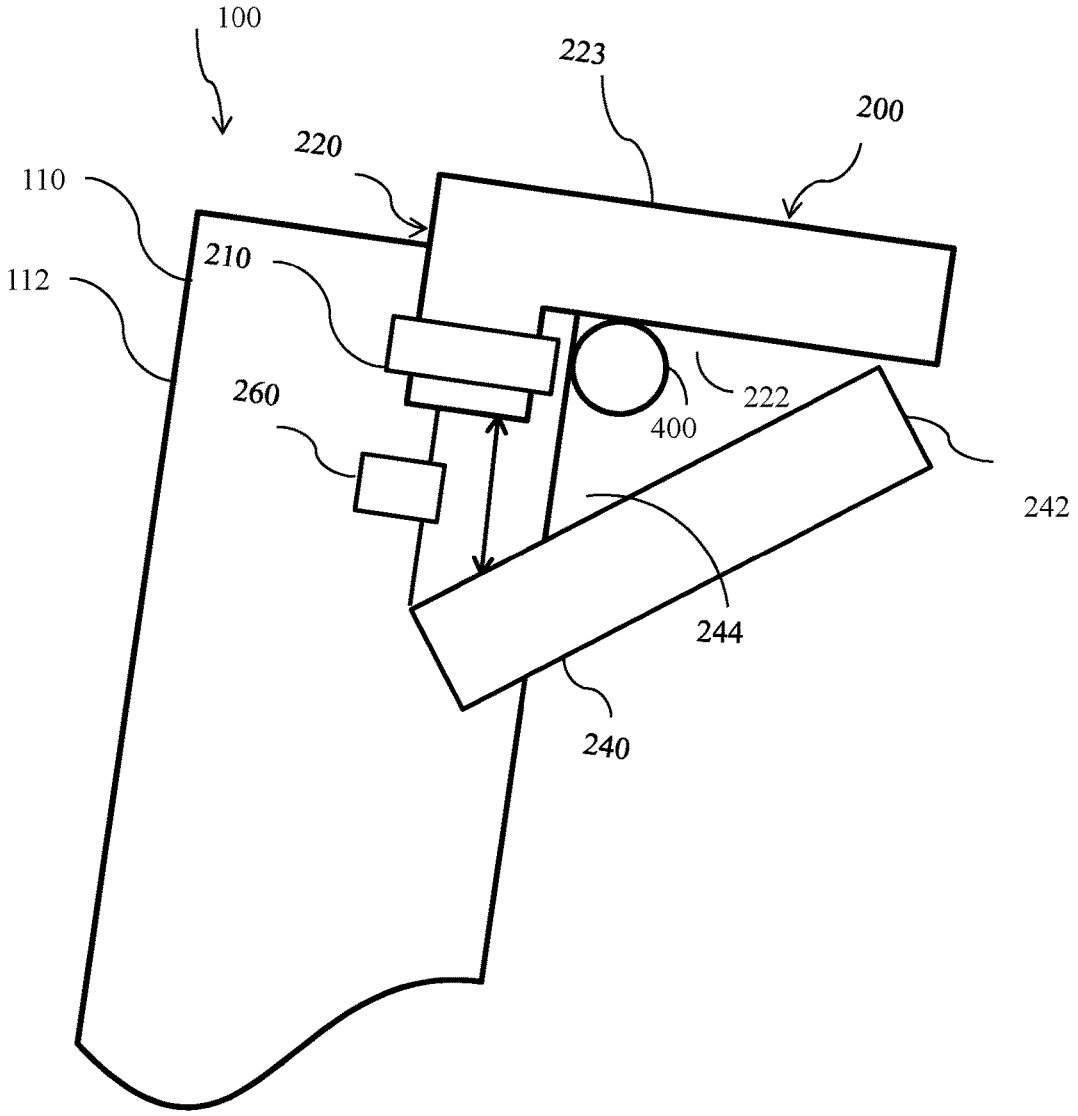
FIG. 4 is an exemplary top-level block diagram illustrating another alternative embodiment of the first safety apparatus of FIG. 2, wherein the first safety apparatus is in a closed position.

The end region 242 of the retention member 240 can be rotatable relative to the engagement member 220 such that the retention member 240 can extend proximally to the engagement member 220 in a closed position (shown in FIG. 4). In the closed position, the selected structure 400 can be trapped in the engagement member recess 222.

The retention member 240 can transition from the open position to the closed position for at least partially enclosing the selected structure 400 within the engagement member recess 222 when weight is applied to the ladder 100. The weight can be applied to the ladder 100 in any appropriate manner. For example, at the onset of use of the ladder 100, the ladder 100 can be loaded onto the selected structure 400 by grasping the selected structure 400 within the engagement member recess 222. Under gravity, weight of the ladder 100 can be at least partially loaded onto the selected structure 400. As a result, the selected structure 400 is in contact with the engagement member 220 and exerts a force to push upward against the engagement member 220 to support the weight of the ladder 100. Effectively, the weight is applied to the ladder 100. Additionally and/or alternatively, an operator can step onto one or more of the rungs 140 (shown in FIG. 1) of the ladder 100 to apply a weight of the operator to the ladder 100.

The retention member 240 can transition from the closed position to the open position for at least partially releasing the selected structure 400 when the weight is removed from the ladder 100. The weight can be removed from the ladder 100 in any appropriate manner. For example, at the end of use of the ladder 100, the ladder 100 can be lifted upward relative to the ground so the selected structure 400 is removed from contact with the engagement member 220. As a result, the selected structure 400 no longer exerts the force to push upward against the engagement member 220 and to support the weight of the ladder 100. Effectively, the weight is removed from the ladder 100. Additionally and/or alternatively, when the operator is on one or more of the rungs 140 during use of the ladder 100. The operator can step off from the rungs 140 to remove the weight of the operator from the ladder 100.

In one embodiment, the first and second safety apparatuses 200, 300 can each transition to capture the selected structure 400 as a weight of the operator is added to a selected rung 140. For example, the weight of the operator is added to the selected rung 140 when an operator steps on the selected rung 140 to load at least part of body weight of the operator onto the ladder 100. The first and second safety apparatuses 200, 300 each can transition to release the selected structure 400 as the weight of the operator is removed from the rung 140.

FIG. 2 shows the first safety apparatus 200 as including an optional biasing system 260 for biasing the engagement member 220 and the retention member 240 into the open position. The biasing system 260 can include any structure that can exert a force for keeping the engagement member 220 and the retention member 240 into the open position when no weight is applied to the ladder 100. An exemplary biasing system 260 can include an elastic object capable of storing mechanical energy. For example, the biasing system 260 can include at least one spring.

FIG. 2 shows the first safety apparatus 200 as including a cooperating member 230 for implementing the cooperation between the engagement member 220 and the retention member 240. The cooperating member 230 can include one or more components that are part of the engagement member 220 and/or the retention member 240. Additionally and/or alternatively, the cooperating mechanism 230 can include one or more components that are in addition to the engagement member 220 and the retention member 240.

The cooperating member 230 can function such that the retention member 240 can transition between the open position and the closed position based on the weight applied to the ladder 100. In one embodiment, the retention member 240 can extend distally from the engagement member 220 to be in the open position when the selected structure 400 does not exert the force that pushes upward against the engagement member 220. The retention member 240 can extend proximally to the engagement member 220 in the closed position when the selected structure 400 exerts the force to push against the engagement member 220.

Additionally and/or alternatively, the first safety apparatus 200 can include a locking system (not shown) for locking the retention member 240 in the closed position. A force can be applied to the first safety apparatus 200 to unlock the retention member 240 from the closed position. For example, the force can include a force that pressures the engagement member 220 toward ground. An exemplary locking system can include any appropriate structure located between the first mounting bracket 210 and the engagement member 220. For example, the locking system can include a locking device having a saw-toothed shape.

Figure 3:
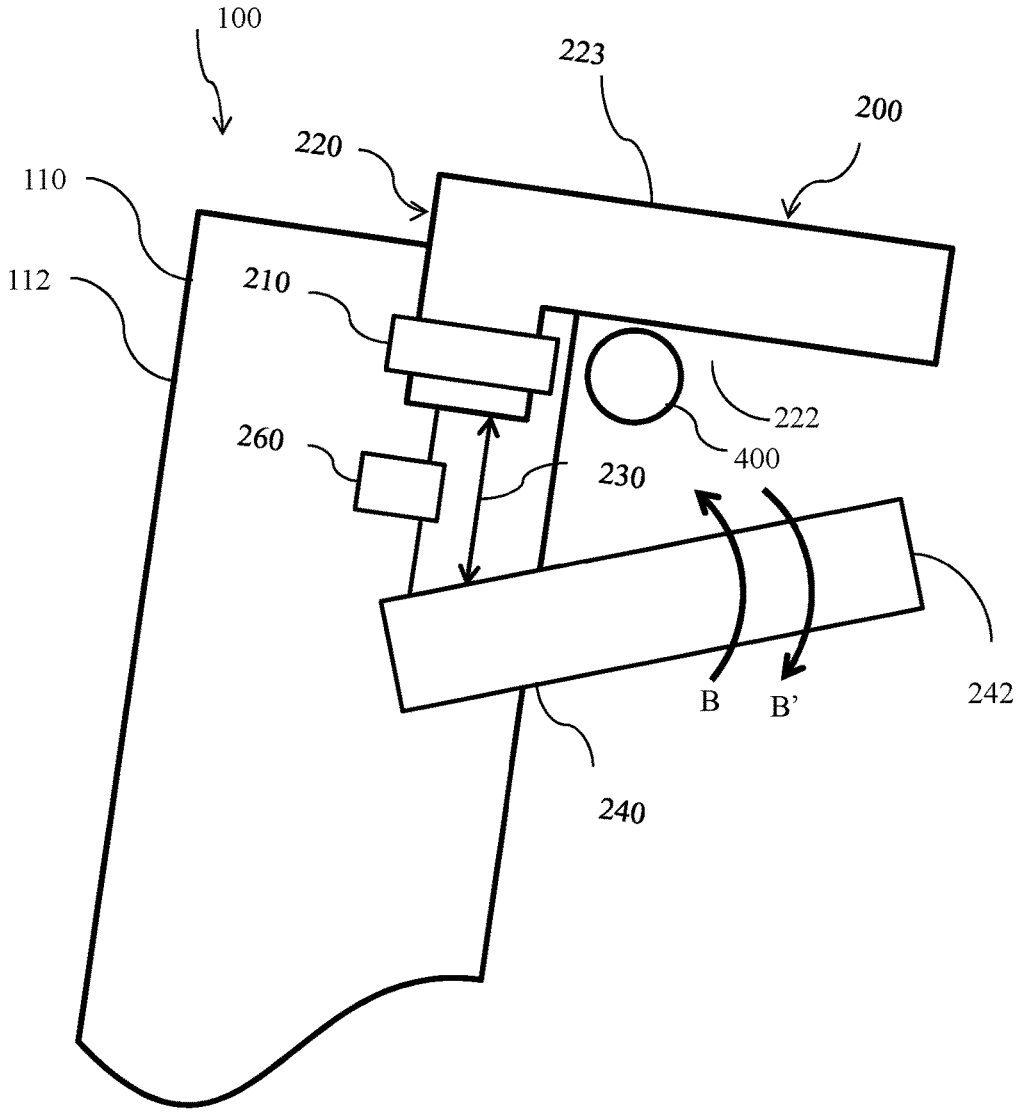
FIG. 3 is an exemplary top-level block diagram illustrating an alternative embodiment of the first safety apparatus of FIG. 2, wherein the first safety apparatus is in an intermediate position during transition between the open position and a closed position.

FIG. 3 shows the first safety apparatus 200 in an intermediate position during transition between the open position (shown in FIG. 2) and the closed position (shown in FIG. 4). An engagement of the selected structure 400 between the engagement member 220 and the retention member 240 in the closed position can progressively increase as additional weight is applied to the ladder 100. Stated somewhat differently, as additional weight is applied to the ladder 100, the retention member 240 can rotate in direction B to reduce opening between the engagement member 220 and the end region 242 of the retention member 240. Thus, likelihood of disengagement of the selected structure 400 from the engagement member recess 222 is reduced.

The engagement of the selected structure 400 by the engagement member 220 and the retention member 240 can progressively decrease as the additional weight is removed from the ladder 100. Stated somewhat differently, as the additional weight is removed from the ladder 100, the retention member 240 can rotate in direction B' to reduce the opening between the engagement member 220 and the end region 242 of the retention member 240. Thus, likelihood of disengagement of the selected structure 400 from the engagement member recess 222 is increased.

FIG. 4 shows the first safety apparatus 200 in the closed position. When the weight is applied to the ladder 100, the retention member 240 can be in the closed position and enclose the selected structure 400 within the engagement member recess 222. The selected structure 400 can thus be trapped within the engagement member recess 222 without a possibility of escaping. Advantageously, detachment of the ladder 100 from the selected structure 400 can be prevented, falling of the ladder 100 to the ground can be avoided, and security of using the ladder 100 can be improved.

As shown in FIG. 4, the retention member 240 defines a retention member recess (also referred to as trap body recess) 244 that cooperates with the engagement member recess 222 such that the selected structure 400 is enclosed within the retention member recess 244 and the engagement member recess 222 when the retention member 240 is in the closed position. Stated somewhat differently, the retention member 240 in the closed position, in cooperation with the upper side rail portion 112 of the first side rail 110, can form the retention member recess 244. The retention member recess 244 and the engagement member recess 222 can form space for trapping the selected structure 400.

Although FIG. 4 shows the retention member 240 as completely enclosing the selected structure 400 within the engagement member recess 222, the retention member 240 in the closed position can partially enclose the selected structure 400 within the engagement member recess 222, without limitation. For example, the opening between the engagement member 220 and the end region 242 of the retention member 240 in the closed position can be smaller than a size of the selected structure 400. Thus, the selected structure 400 can still be trapped within the engagement member recess 222 without the possibility of escaping. Advantageously, security of using the ladder 100 can be improved. When the weight is removed from the ladder 100, the retention member 240 can transition to the open position (shown in FIG. 2) and release the selected structure 400.

Although the view the first safety apparatus 200 of in FIG. 4 shows the retention member 240 as completely enclosing the selected structure 400 within the engagement member recess 222 without an overlap with the engagement member 220, the retention member 240 and the engagement member 220 can be in any relative position for engaging the selected structure 400, without limitation. For example, the retention member 240 in the closed position can at least partially overlap with the engagement member 220 in a view that is the same as the view in FIG. 4

Figure 5:
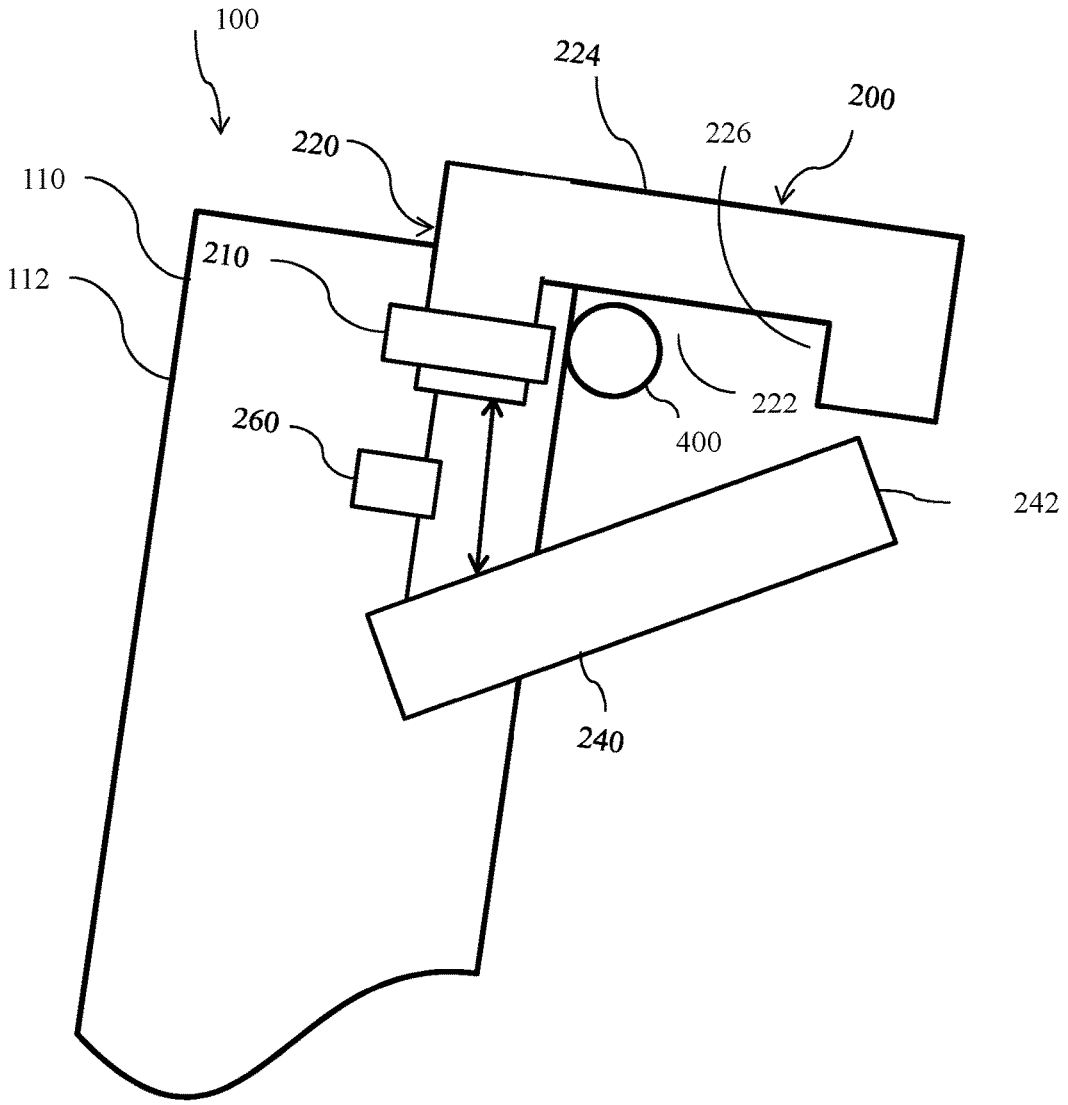
FIG. 5 is an exemplary block diagram illustrating another still alternative embodiment of the first safety apparatus of FIG. 2, wherein an engagement member of the first safety apparatus includes a hook.

FIG. 5 shows the engagement member 220 as including a hook (also referred to as cable hook) 224 defining a hook mouth 226. As shown in FIG. 5, in the closed position, the retention member 240 can at least partially enclose the selected structure 400 within the hook mouth 226 when the weight is applied to the ladder 100.

The selected structure 400 can be secured within the hook mouth 226 at the onset of use of the ladder 100. Thus, during transition of the retention member 240 from the open position to the closed position, detachment of the selected structure 400 from the engagement member 220 can be prevented. Advantageously, success of trapping the selected structure 400 within the engagement member recess 222 can be ensured, and safety and convenience of using the ladder 100 can be improved.

Although FIG. 5 shows the hook mouth 226 as having a rectangular shape, the hook mouth 226 can include having any type of indented portion for accommodating the selected structure 400. For example, the hook mouth 226 can be curved, triangular, square, rectangular, or a combination thereof.

Figure 6:
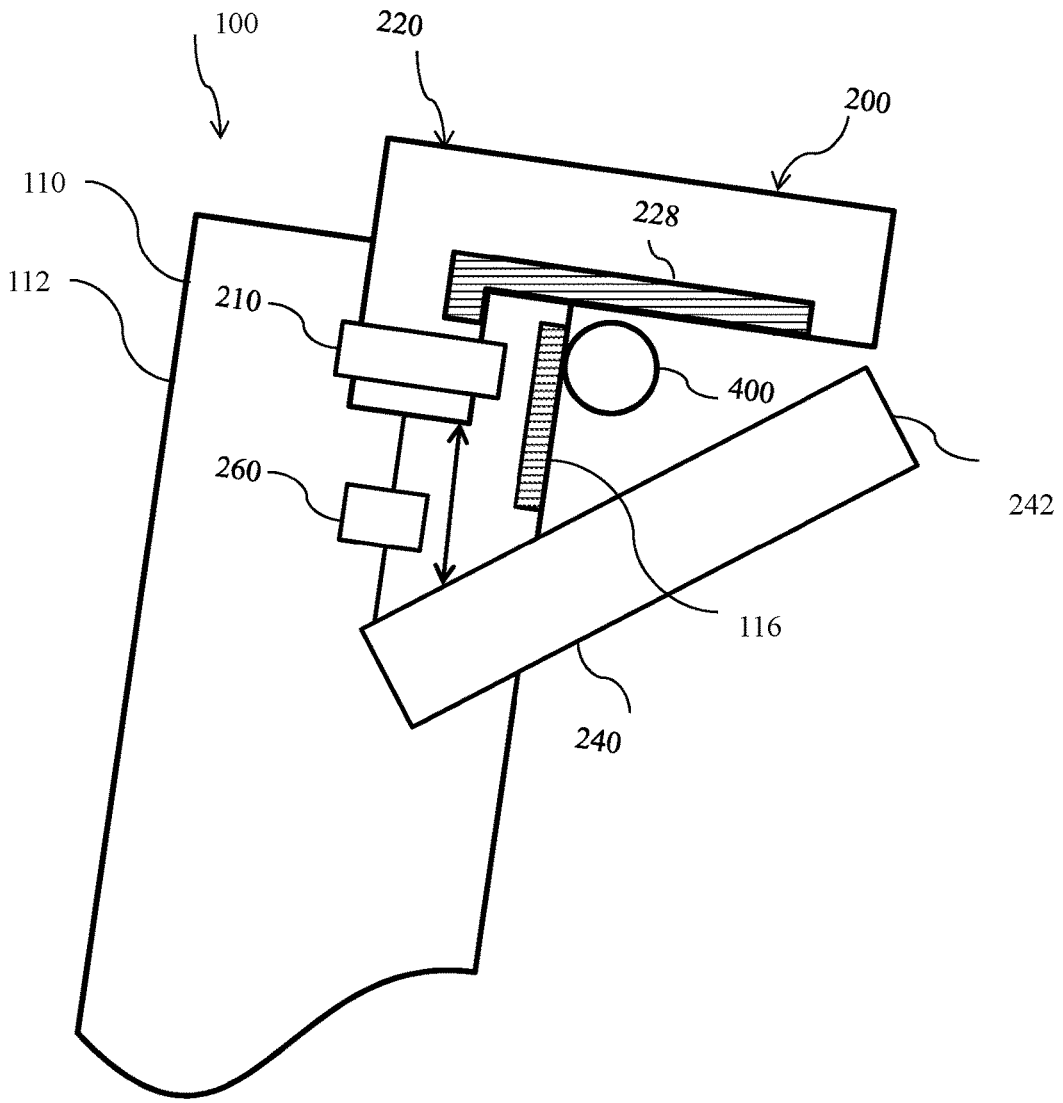
FIG. 6 is an exemplary block diagram illustrating still another alternative embodiment of the first safety apparatus of FIG. 2, wherein an engagement member of the first safety apparatus is at least partially lined with a non-skid surface material.

Turing to FIG. 6, the engagement member 220 is shown as being at least partially lined with a non-skid surface material 228 for securing an engagement between the engagement member 220 and the selected structure 400. Advantageously, relative slipping and/or sliding motion between the engagement member 220 and the selected structure 400 can be reduced or eliminated. Stability of the ladder 100 during use can advantageously be improved.

Additionally and/or alternatively, the upper side rail portion 112 of the first side rail 110 is shown as being at least partially lined with a non-skid surface material 116 for securing the engagement with the selected structure 400. Advantageously, relative slipping and/or sliding motion between the first side rail 110 and the selected structure 400 can be reduced or eliminated. Stability of the ladder 100 during use can advantageously be improved.

The non-skid surface materials 228, 116, also referred to as non-slip materials or anti-slip materials, can include any materials that has a high friction with the selected structure 400. In a non-limiting example, the non-skid surface materials 228, 116 can include neoprene, ethylene propylene diene monomer (M-class) rubber (EPDM rubber), polyvinyl chloride (PVC) foam, polyethylene, sponge rubber, silicone foam, urethane, cork, rubber, felt, acrylic, polyester, styrene-butadiene or styrene-butadiene rubber (SBR), or a combination thereof. The non-skid surface materials 228, 116 be uniform and/or different.

Optionally, the upper side rail portion 122 (shown in FIG. 1) of the second side rail 120 (shown in FIG. 1) can be at least partially lined with a non-skid surface material (not shown) for securing the engagement with the selected structure 400. The non-skid surface material on the upper side rail portion 122 can be uniform with and/or different from the non-skid surface materials 228, 116. In one embodiment, the non-skid surface material on the upper side rail portion 122 can be uniform with the non-skid surface material 228, so the upper side rail portions 112, 122 can equally resist skidding of the selected structure 400. Advantageously, the ladder 100 can be symmetrically secured with the selected structure 400 and stability of the ladder 100 during use can be improved.

Figure 7:
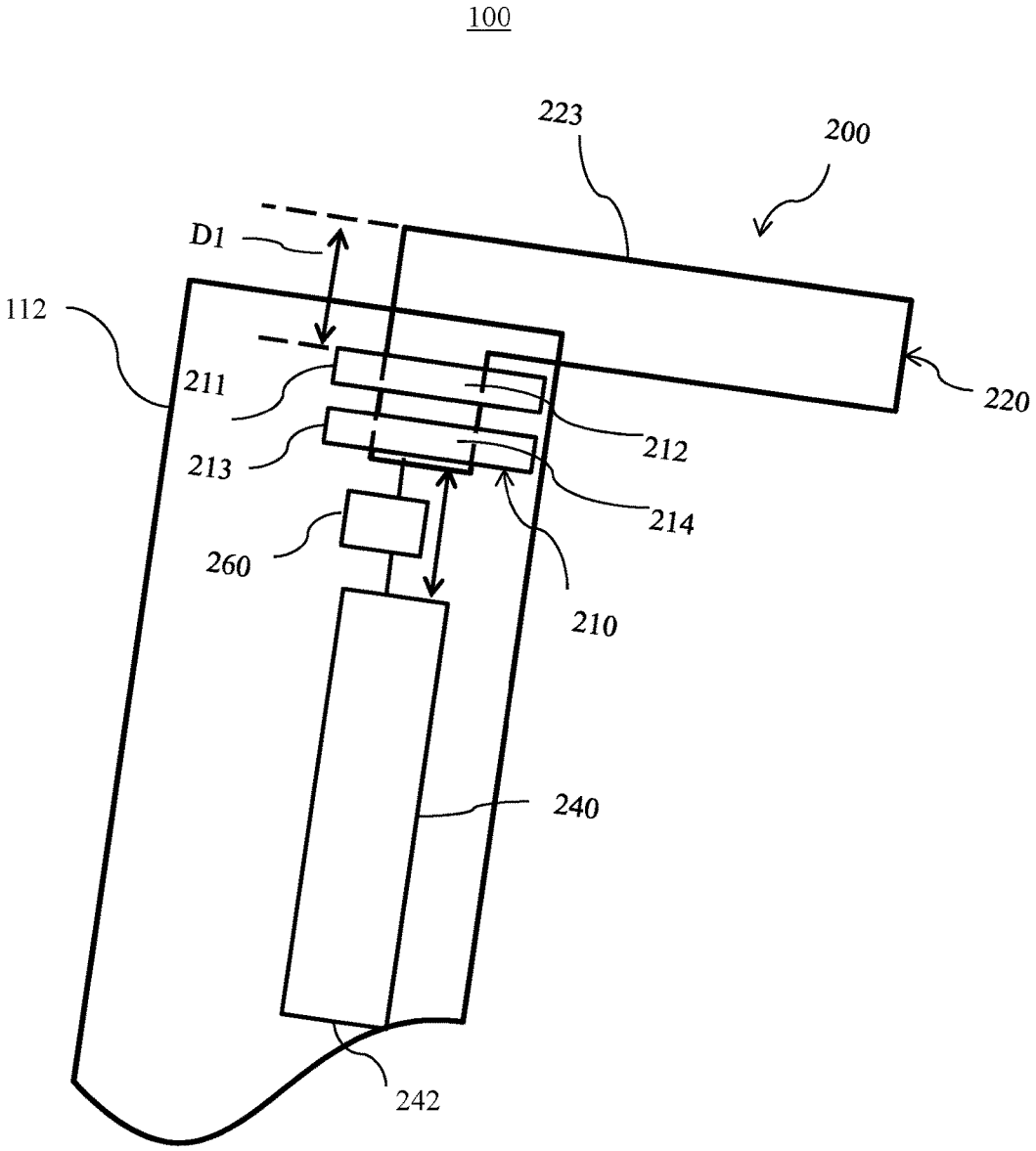
FIG. 7 is an exemplary block diagram illustrating still another alternative embodiment of the first safety apparatus of FIG. 2, wherein the first safety apparatus is coupled with the ladder via a mounting bracket including first and second bracket members.

Turning to FIG. 7, the first mounting bracket 210 is shown as including a first bracket member 211 defining a first bracket opening 212 (indicated via dashed lines) and a second bracket member 213 defining a second bracket opening 214 (indicated via dashed lines). FIG. 7 shows the second bracket opening 214 as being axially aligned with the first bracket opening 212. The engagement member 220 is shown as being at least partially disposed within the first and second bracket openings 212, 214 and extends from the first and second bracket members 211, 212.

As shown in FIG. 7, when the retention member 240 is in the open position, the engagement member portion 223 extends from the first bracket member 211 by a first predetermined distance D1. Stated somewhat differently, when no weight is applied to the ladder 100, the engagement member portion 223 extends from the first bracket member 211 by the first predetermined distance D1.

Figure 8:
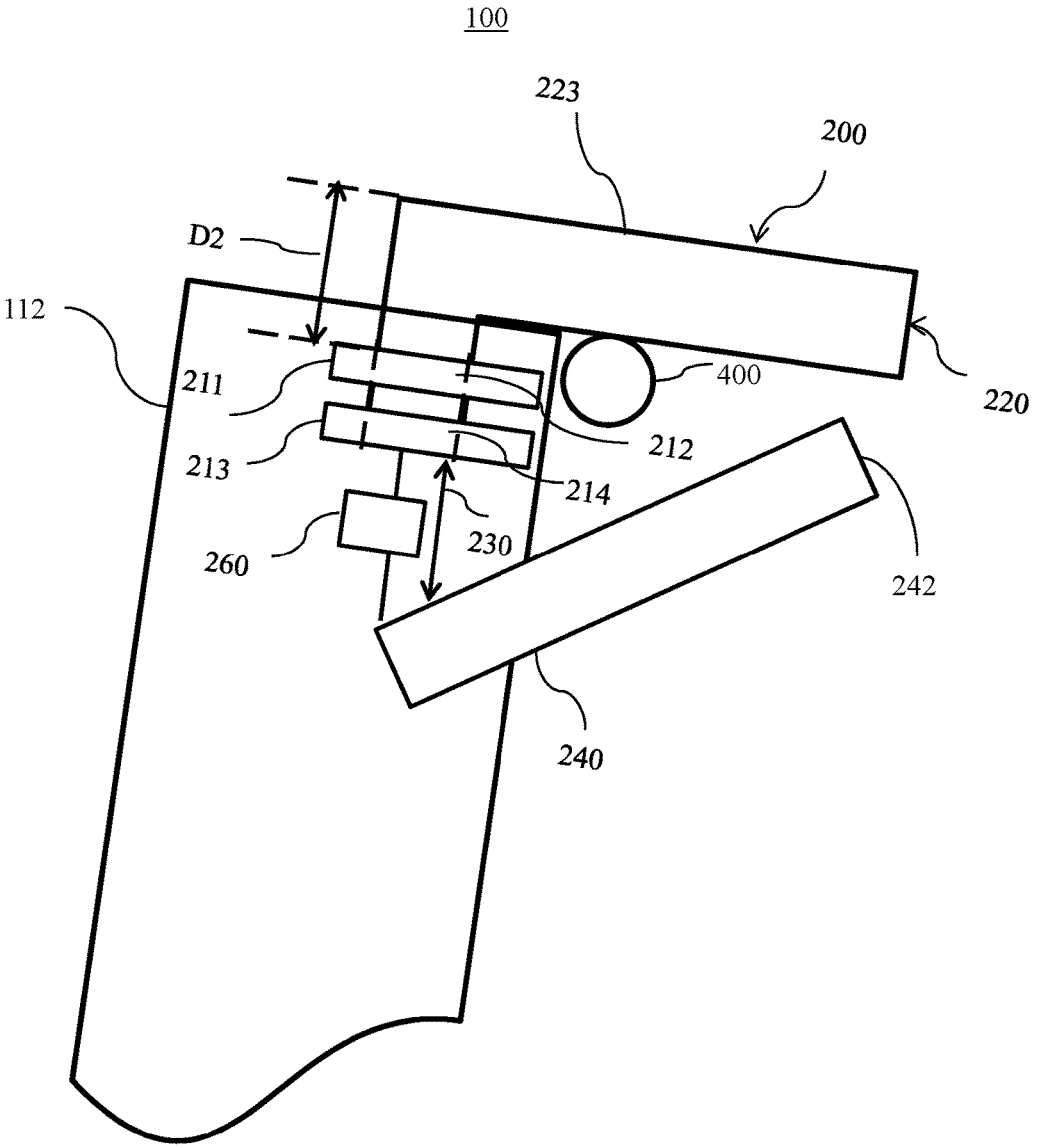
FIG. 8 is an exemplary block diagram illustrating an alternative embodiment of the first safety apparatus of FIG. 7, wherein a weight is applied to the ladder.

Turning to FIG. 8, the retention member 240 is shown as being in the closed position. For example, the weight can be applied to the ladder 100. In response to the weight being applied to the ladder 100, the engagement member 220 can slide within the first and second bracket openings 212, 214. As a result, the engagement member portion 223 is shown as extending from the first bracket member 211 by a second predetermined distance D2.

The second predetermined distance D2 is shown as being greater than the first predetermined distance D1 (shown in FIG. 7). Stated somewhat differently, the selected structure 400 can exert the force to push against the engagement member 220 and thus move the engagement member portion 223 relative to the first bracket member 211. The cooperating member 230 can function to rotate the retention member 240 from the open position to the closed position in response to shifting of the engagement member portion 223 distally from the first bracket member 211.

Figure 9:
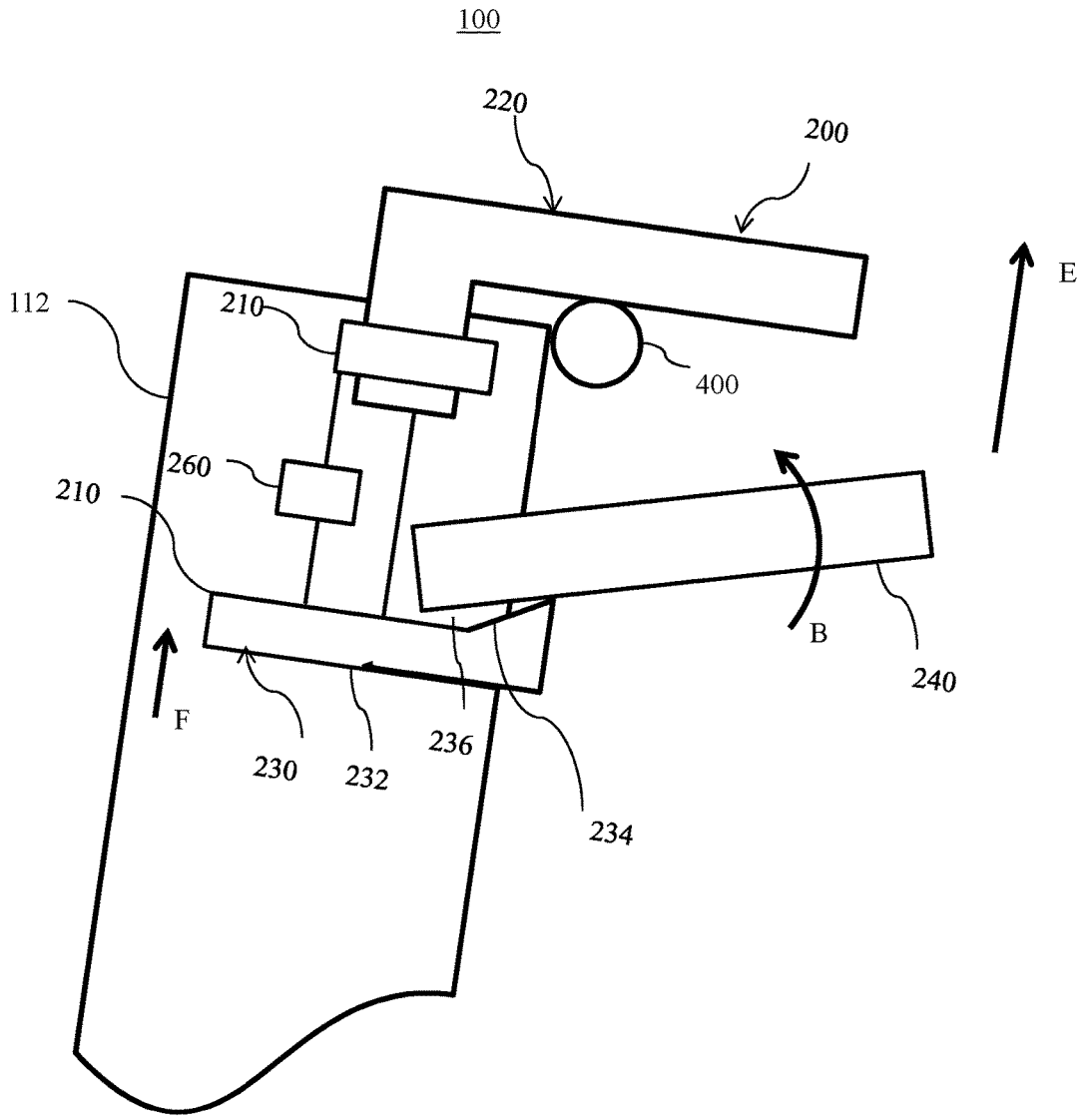
FIG. 9 is an exemplary block diagram illustrating still another alternative embodiment of the first safety apparatus of FIG. 2, wherein a compressing member extends from an engagement member of the first safety apparatus.

FIG. 9 shows the first safety apparatus 200 in an intermediate position during transition between the open position (shown in FIG. 2) and the closed position (shown in FIG. 4). The cooperating member 230 is shown as including a compressing member 232 extending from the engagement member 220.

The compressing member 232 can be coupled to the engagement member 220 for moving synchronously with the engagement member 220. For example, the compressing member 232 can be fixedly coupled to and/or supported by the engagement member 220. Thus, when the weight is applied to the ladder 100, the engagement member 220 can slide relative to the first mounting bracket 210 in a direction E. The direction E can indicate a first selected direction that at least partially points away from the ground when the ladder 100 is in use. The compressing member 232 can move in a direction F. The direction F can indicate a second selected direction that at least partially points away from the ground when the ladder 100 is in use. The direction E can be parallel to the direction F. Additionally and/or alternatively, a difference between the directions E, F can be smaller than 90 degrees so the compressing member 232 can move farther from the ground when the engagement member 220 moves farther from the ground.

Via movement in the direction F, the compressing member 232 can engage the retention member 240 to transition the retention member 240 into the closed position. Stated somewhat differently, the compressing member 232 can push the retention member 240 such that the retention member 240 can rotate in the direction B to transition into the closed position. FIG. 9 shows the compressing member 232 as including an angled end portion 234 at end of the compressing member 232 and extending proximally to the retention member 240. The angled end portion 234 defines a compressing member recess 236 facing the retention member 240. The angled end portion 234 can provide support to the retention member 240 such that the retention member 240 can rotate into the closed position during movement in the direction F. Optionally, in the closed position, a surface of the angled end portion 234 can be in contact with a surface of the retention member 240 proximal to the angled end portion 234.

Optionally, the biasing system 260 can include at least one spring (not shown) being disposed between the compressing member 232 and the mounting bracket 210. The spring can bias the compressing member 232 distally from the retention member 240. Stated somewhat differently, when the weight is not applied to the ladder 100, the spring can provide a force to keep the compressing member 232 from moving in the direction F and/or move relative to the mounting bracket 210. Thus, the spring can prevent the compressing member 232 from contacting the retention member 240 and/or pushing the retention member 240 into the closed position. In one example, the biasing system 260 can include a plurality of springs coupled in series and/or in parallel.

Figure 10:
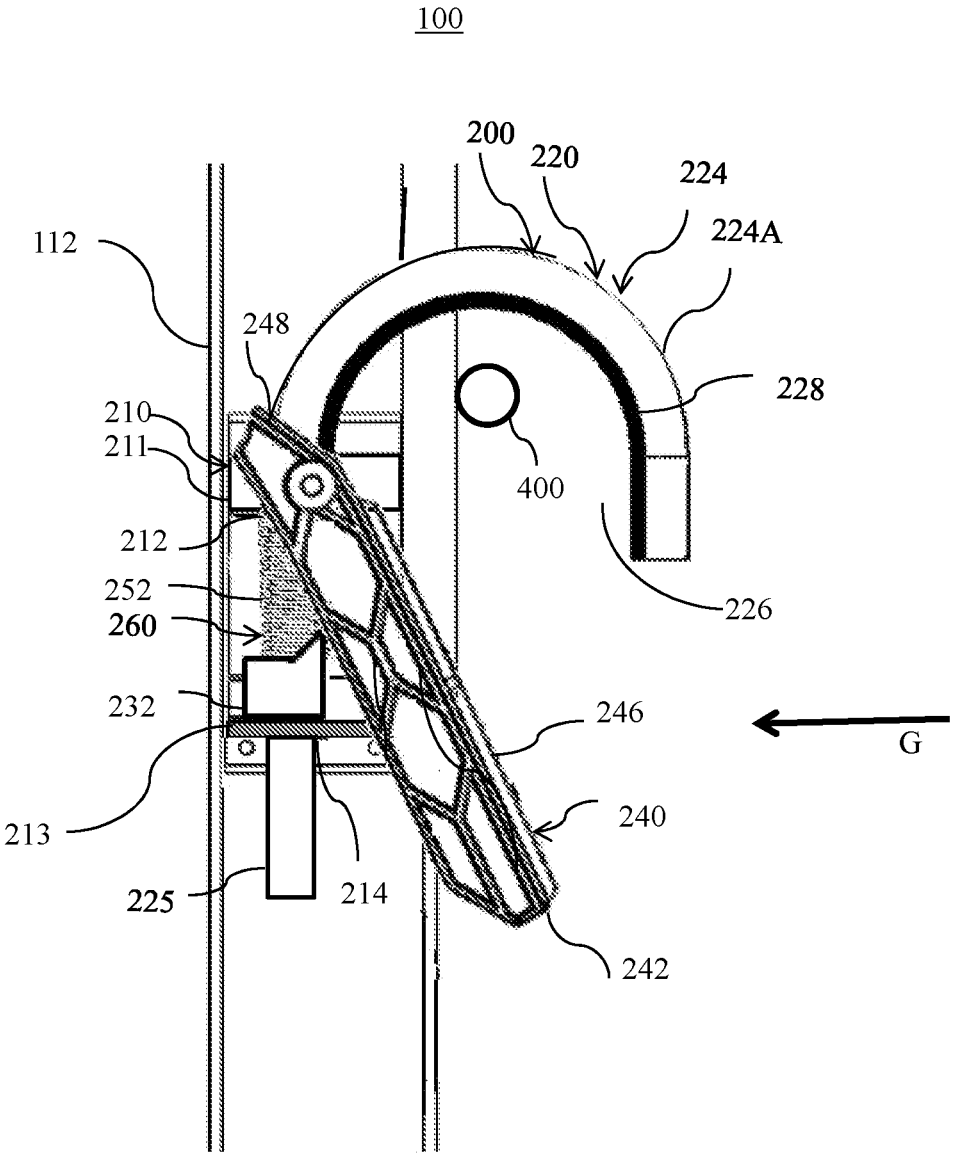
FIG. 10 is an exemplary detailing drawing illustrating an alternative embodiment of the first safety apparatus of FIG. 9, wherein the first safety apparatus is in an open position.

FIG. 10 shows a detail drawing of the ladder 100 with the first safety apparatus 200 in the open position. The first safety apparatus 200 is shown as including the first mounting bracket 210 with the first bracket member 211 defining the first bracket opening 212 and the second bracket member 213 defining the second bracket opening 214. The second bracket opening 214 is shown as being axially aligned with the first bracket opening 212.

The first safety apparatus 200 is shown as including the engagement member 220 that includes the hook 224. The hook 224 can include a hook region 224A having an arcuate shape for defining the hook mouth 226. The engagement member 220 is shown as including a hook base region 225 having a hook base region periphery 227 (shown in FIG. 11) that can include an external circumference of the hook base region 225. The compressing member 232 can extend from the hook base region periphery. The hook base region 225 is shown as disposed within the first and second bracket openings 212, 214, such that the compressing member 232 can be slidable between the first and second bracket members 211, 213. The hook 224 is shown as extending from the first bracket member 211 and lined with the non-skid surface material 228.

The biasing system 260 shown in FIG. 10 includes at least one spring 252 being disposed about the hook base region periphery between the first bracket member 211 and the compressing member 232 and biasing the compressing member 232 adjacent to the second bracket member 213.

The first safety apparatus 200 is shown as including the retention member 240. The retention member 240 includes a cable trap body 246. The cable trap body 246 can have an elongated shape and have the end region 242 and an end region (also referred to as cable trap end region) 248 opposite to the end region 242. The end region 248 can be pivotally coupled with the first bracket member 211 such that the cable trap body 246 can extend adjacent to the second bracket member 213 in the open position. The cable trap body 246 can enclose the hook mouth 226 in the closed position (shown in FIG. 13).

Figure 11:
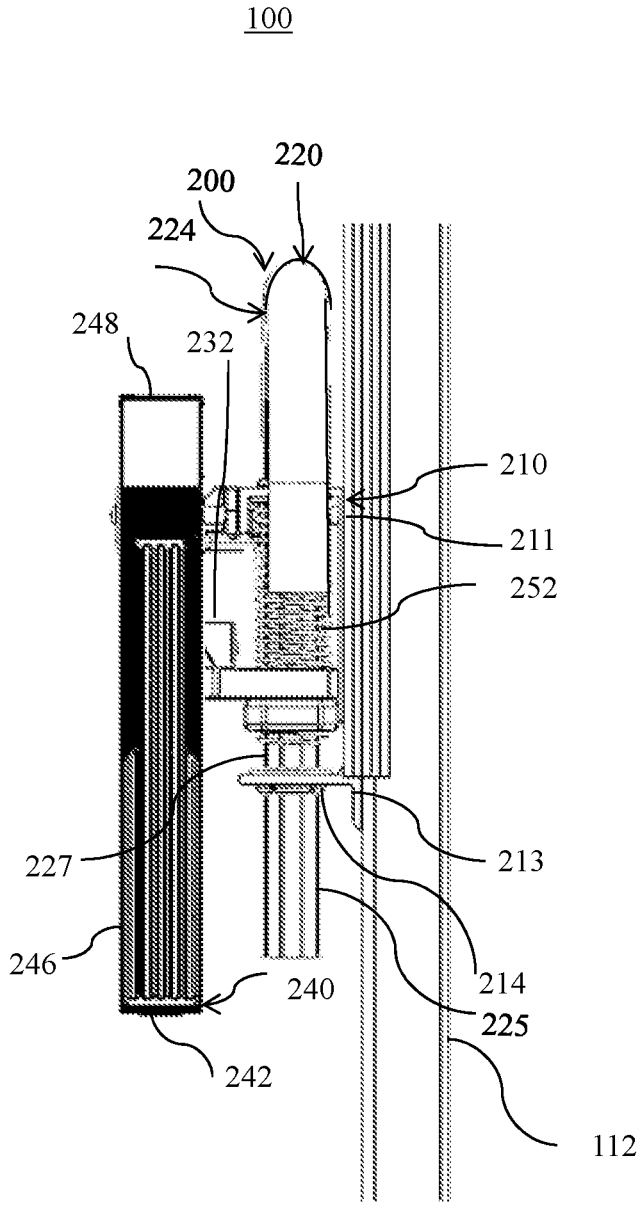
FIG. 11 is an exemplary detailing drawing illustrating an alternative embodiment of the first safety apparatus of FIG. 10, wherein the first safety apparatus is viewed in a direction perpendicular to a plane parallel with rungs of the ladder.

FIG. 11 shows the first safety apparatus 200 of FIG. 10 that is viewed in a direction G (shown in FIG. 10). The direction G is perpendicular to a plane parallel with rungs 140 (shown in FIG. 1) of the ladder 100. A hook base region periphery 227 is shown as extending from the hook base region 225 and located distally from the upper side rail portion 112. The end region 248 can be pivotally coupled with the first bracket member 211 and located distally from the upper side rail portion 112.

The compressing member 232 is shown as extending from the hook base region periphery 227 and distally from the upper side rail portion 112 such that any movement of the compressing member 232 between the first and second bracket members 211, 213 is at least partially aligned with elongation direction of the cable trap body 246.

Figure 12:
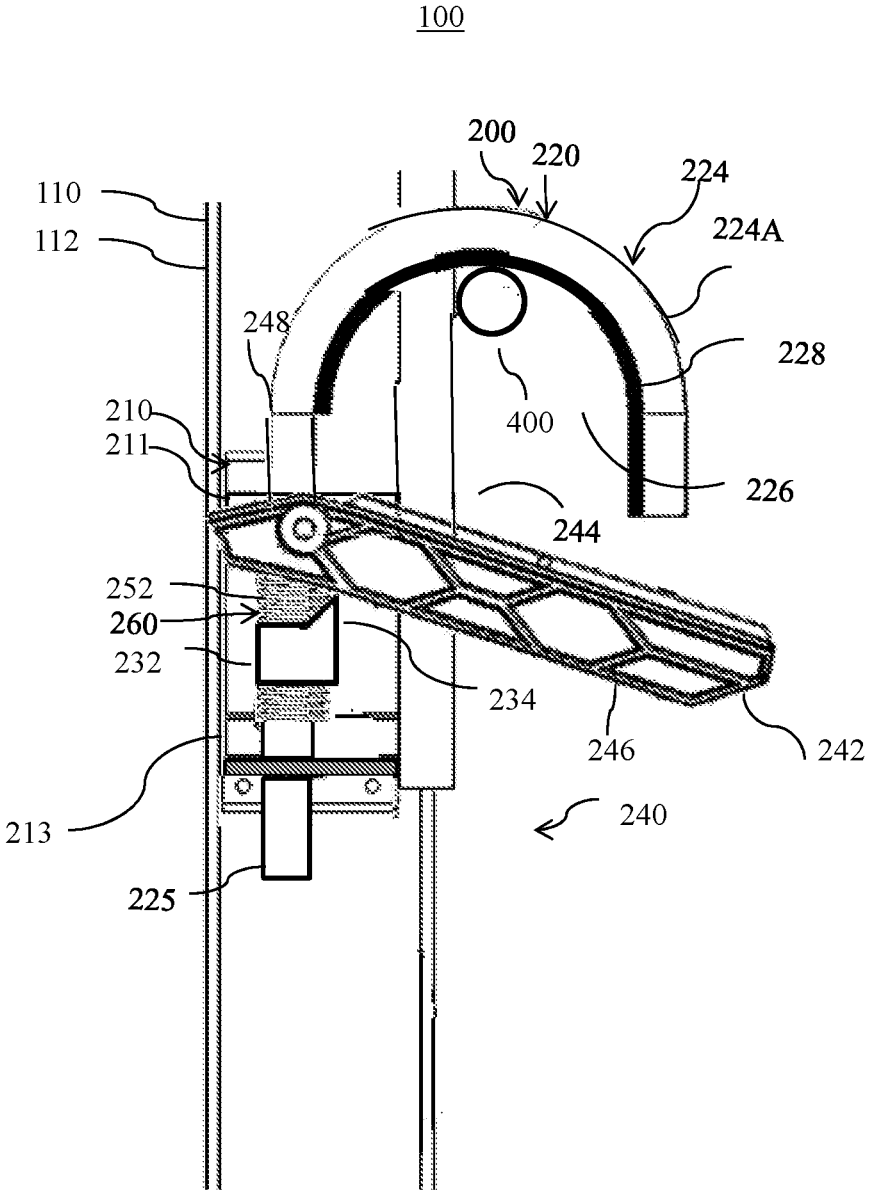
FIG. 12 is an exemplary detailing drawing illustrating another alternative embodiment of the first safety apparatus of FIG. 10, wherein the first safety apparatus is in an intermediate position during transition between the open position and a closed position.
Figure 13:
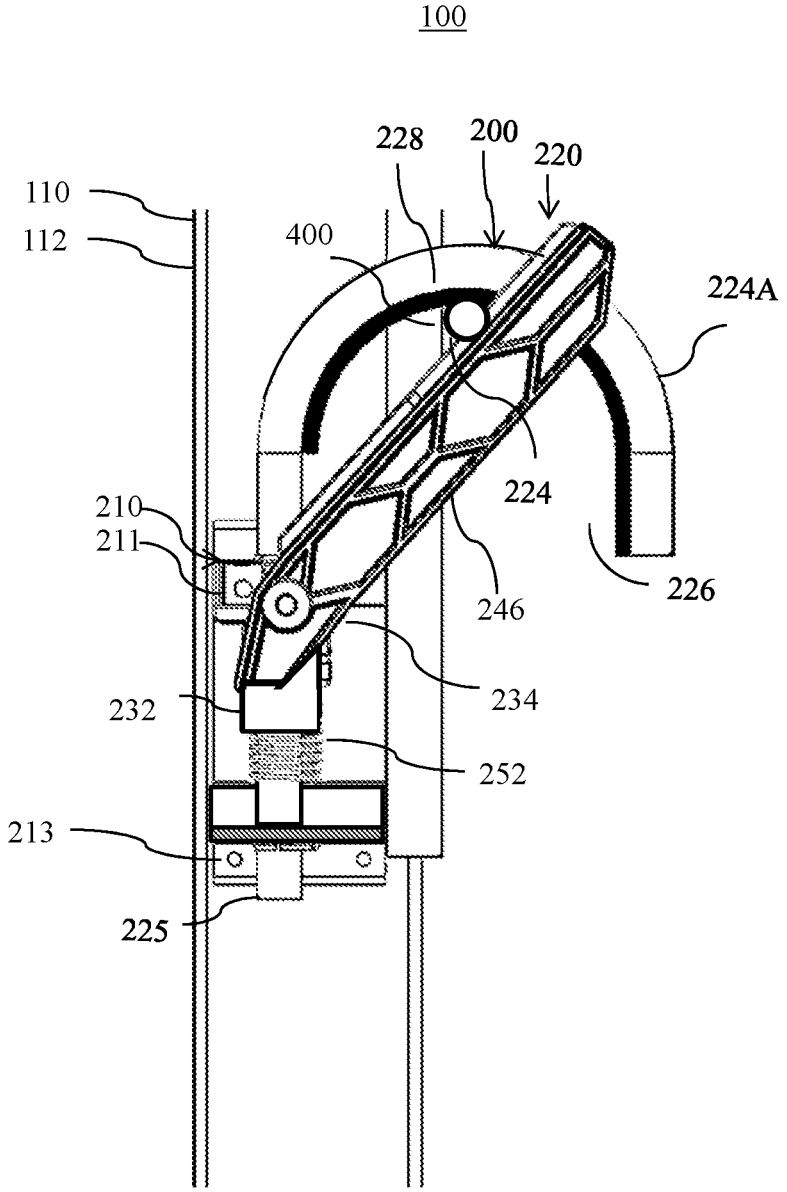
FIG. 13 is an exemplary detailing drawing illustrating still another alternative embodiment of the first safety apparatus of FIG. 10, wherein the first safety apparatus is in a closed position.

FIG. 12 shows the first safety apparatus 200 in an intermediate position during transition between the open position (shown in FIG. 10) and the closed position (shown in FIG. 13). The cable trap body 246 is shown as defining the retention member recess 244. Stated somewhat differently, the cable trap body 246 in the closed position, in cooperation with the upper side rail portion 112 of the first side rail 110, can form the retention member recess 244.

As shown in FIG. 12, as the compressing member 232 slides toward the first bracket member 211 during use of the ladder 100, the compressing member 232 compresses the spring 252 and engages the cable trap body 246 to rotate the cable trap body 246 toward the hook 224. As illustrated in FIG. 12, the selected structure 400, such as a safety cable, exerts a force to move the hook 224 relative to the first and second bracket members 211, 213. The compressing member 232 compresses the spring 252 and engages the cable trap body 246 via the angled end portion 234.

FIG. 13 shows the first safety apparatus 200 in the closed position. As the compressing member 232 slides toward the first bracket member 211 further (in comparison with FIG. 12), the compressing member 232 can further compress the spring 252 and engage the cable trap body 246 to transition the cable trap body 246 to the closed position to capture the selected structure 400 within the hook mouth 226 between the non-skid surface material 228 and the retention member recess 244.

Figure 14:
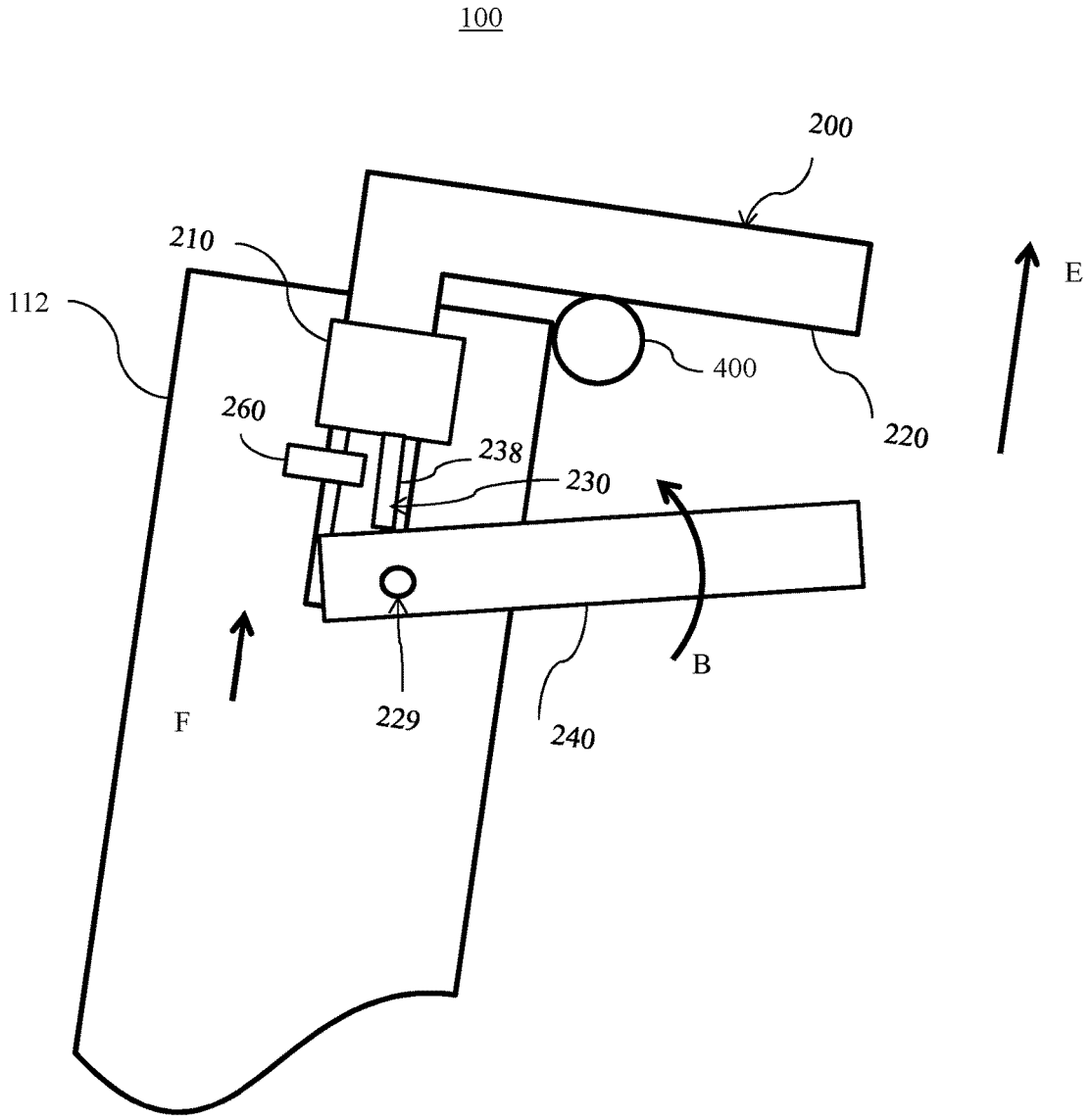
FIG. 14 is an exemplary block diagram illustrating still another alternative embodiment of the first safety apparatus of FIG. 2, wherein a retention member of the first safety apparatus is rotatably coupled with an engagement member of the first safety apparatus.

FIG. 14 shows the first safety apparatus 200 in an intermediate position during transition between the open position (shown in FIG. 2) and the closed position (shown in FIG. 4). The cooperating member 230 is shown as including a levering member 238 extending from the first mounting bracket 210.

The retention member 240 is shown as being rotatably coupled with the engagement member 220. When the weight is applied to the ladder 100, the engagement member 220 can slide relative to the first mounting bracket 210 such that the engagement member 220 can engage the first mounting bracket 210 to rotate the retention member 240 into the closed position.

The retention member 240 can be coupled to the engagement member 220 for making a translation movement synchronously with the engagement member 220. Thus, when the weight is applied to the ladder 100, the engagement member 220 can slide relative to the first mounting bracket 210 in the direction E. Accordingly, the retention member 240 can move in the direction F. Via movement in the direction F, the engagement member 220 can engage the first mounting bracket 210 to rotate the retention member 240 into the closed position. Stated somewhat differently, the levering member 238 can make the retention member 240 pivot such that the retention member 240 can rotate in the direction B to transition into the closed position.

FIG. 14 shows the retention member 240 as being rotatably coupled with the engagement member 220 via a support member 229 extending from the engagement member 220. The biasing system 260 can include at least one spring (not shown) being disposed between the support member 229 and the first mounting bracket 210. The biasing system 260 can bias the retention member 240 distally from the engagement member recess 222 of the engagement member 220.

Stated somewhat differently, when the weight is not applied to the ladder 100, the biasing system 260 can provide a force to keep the retention member 240 from moving in the direction F and/or move relative to the mounting bracket 210. Thus, the biasing system 260 can prevent the levering member 238 from contacting the retention member 240 and/or pushing the retention member 240 to pivot into the closed position.

Figure 15:
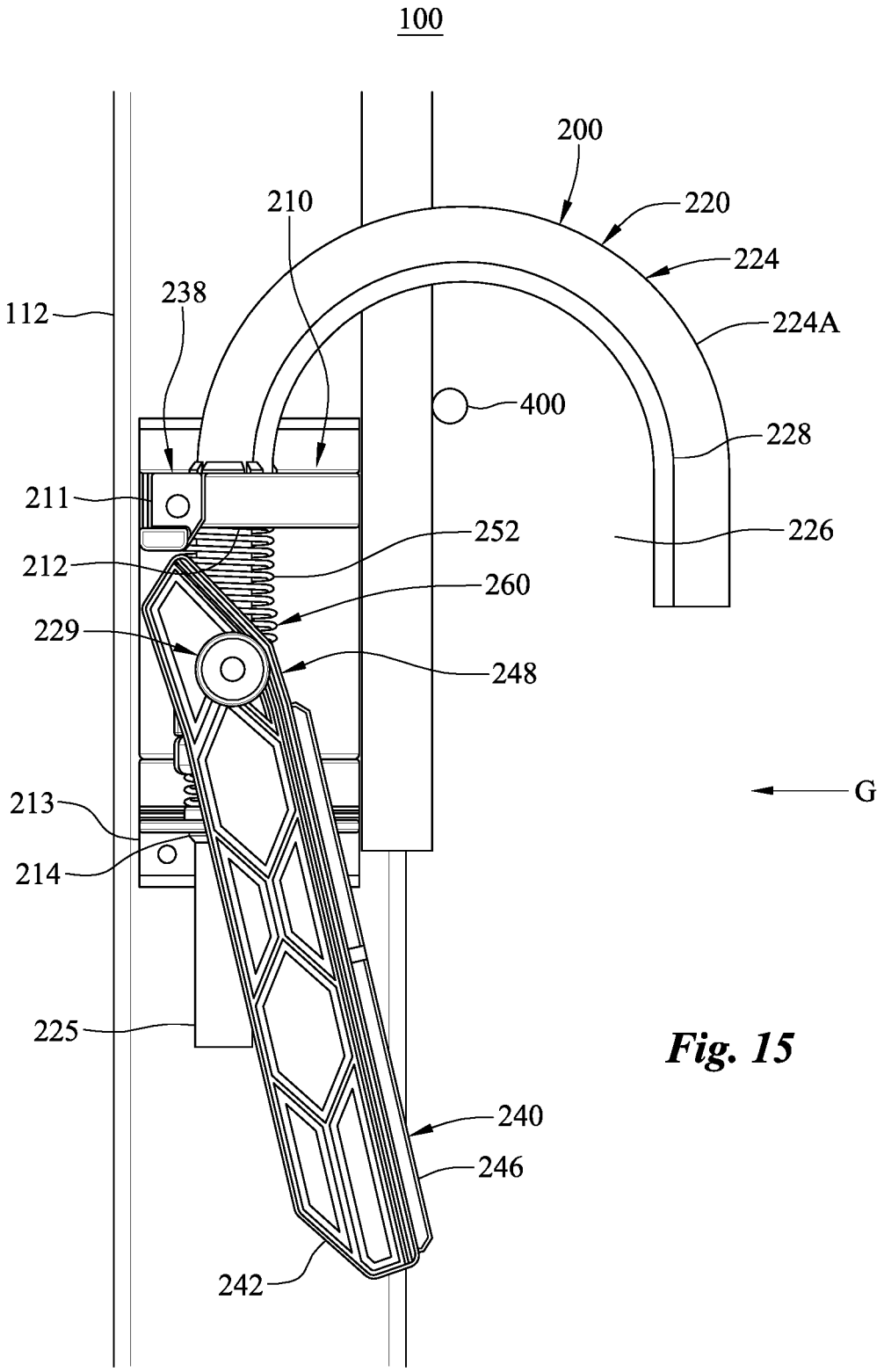
FIG. 15 is an exemplary detailing drawing illustrating an alternative embodiment of the first safety apparatus of FIG. 14, wherein the first safety apparatus is in an open position.

FIG. 15 shows a detail drawing of the first safety apparatus 200 in the open position. The first safety apparatus 200 is shown as including the first mounting bracket 210 with the first bracket member 211 defining the first bracket opening 212 and the second bracket member 213 defining the second bracket opening 214. The second bracket opening 214 is shown as being axially aligned with the first bracket opening 212.

The first safety apparatus 200 is shown as including the engagement member 220 that includes the hook 224. The hook 224 can include a hook region 224A having an arcuate shape for defining the hook mouth 226. The engagement member 220 is shown as including a hook base region 225 having an external hook base region periphery 227 (shown in FIG. 16).

The engagement member 220 is shown as including the support member 229 extending from the hook base region periphery. The hook base region 225 can be slidably disposed within the first and second bracket openings 212, 214 such that the hook 224 extends from the first bracket member 211 and the support member 229 can be positioned between the first and second bracket members 211, 213.

The biasing system 260 shown in FIG. 15 includes a spring 252 disposed about the hook base region periphery between the first bracket member 211 and the support member 229. The spring 252 can bias the support member 229 adjacent to the second bracket member 213.

The first safety apparatus 200 is shown as including the retention member 240. The retention member 240 includes the cable trap body 246. The cable trap body 246 can have an elongated shape and have the end region 242. The end region 242 is shown as being distal from the hook 224. Stated somewhat differently, the end region 242 can extend distally from the hook 224 in the open position.

The cable trap body 246 can have an end region 248 located opposite to the end region 242. The end region 248 is shown as being proximal to the hook 224. Stated somewhat differently, the end region 248 can be proximal to the hook 224 in the open position.

Figure 16:
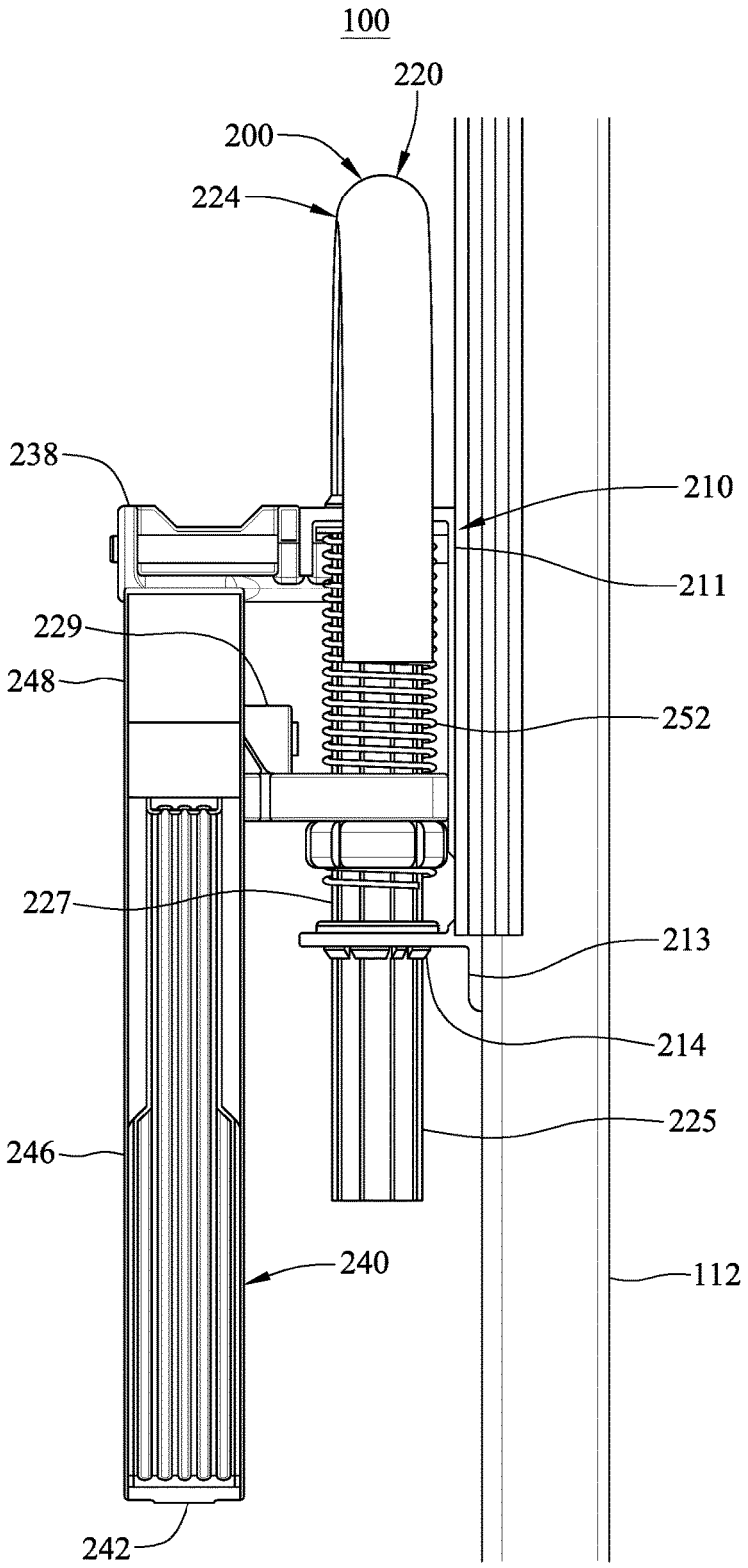
FIG. 16 is an exemplary detailing drawing illustrating an alternative embodiment of the first safety apparatus of FIG. 15, wherein the first safety apparatus is viewed in a direction perpendicular to a plane parallel with rungs of the ladder.

FIG. 16 shows the first safety apparatus 200 of FIG. 15 that is viewed in the direction G (shown in FIG. 15). A hook base region periphery 227 is shown as extending from the hook base region 225 and located distally from the upper side rail portion 112. The end region 248 can be pivotally coupled with the first bracket member 211 and located distally from the upper side rail portion 112.

The support member 229 is shown as extending from the hook base region periphery 227 and coupled to the cable trap body 246. The levering member 238 is shown as extending from the first mounting bracket 210 and distally from the upper side rail portion 112 such that the levering member 238 can be in contact with the cable trap body 246 during movement of the cable trap body 246 in the direction E (shown in FIG. 14).

Figure 17:
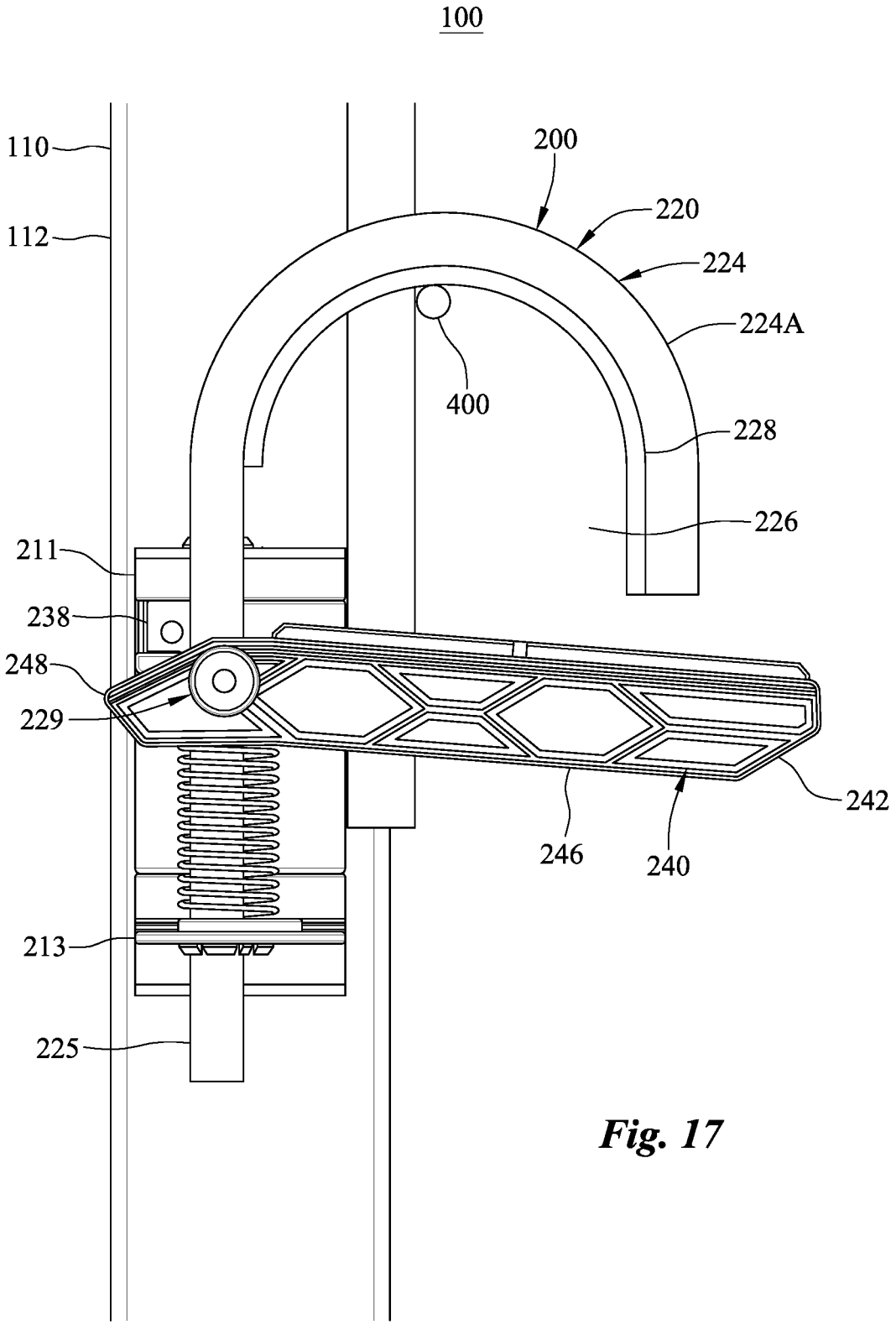
FIG. 17 is an exemplary detailing drawing illustrating another alternative embodiment of the first safety apparatus of FIG. 15, wherein the first safety apparatus is in an intermediate position during transition between the open position and a closed position.
Figure 18:
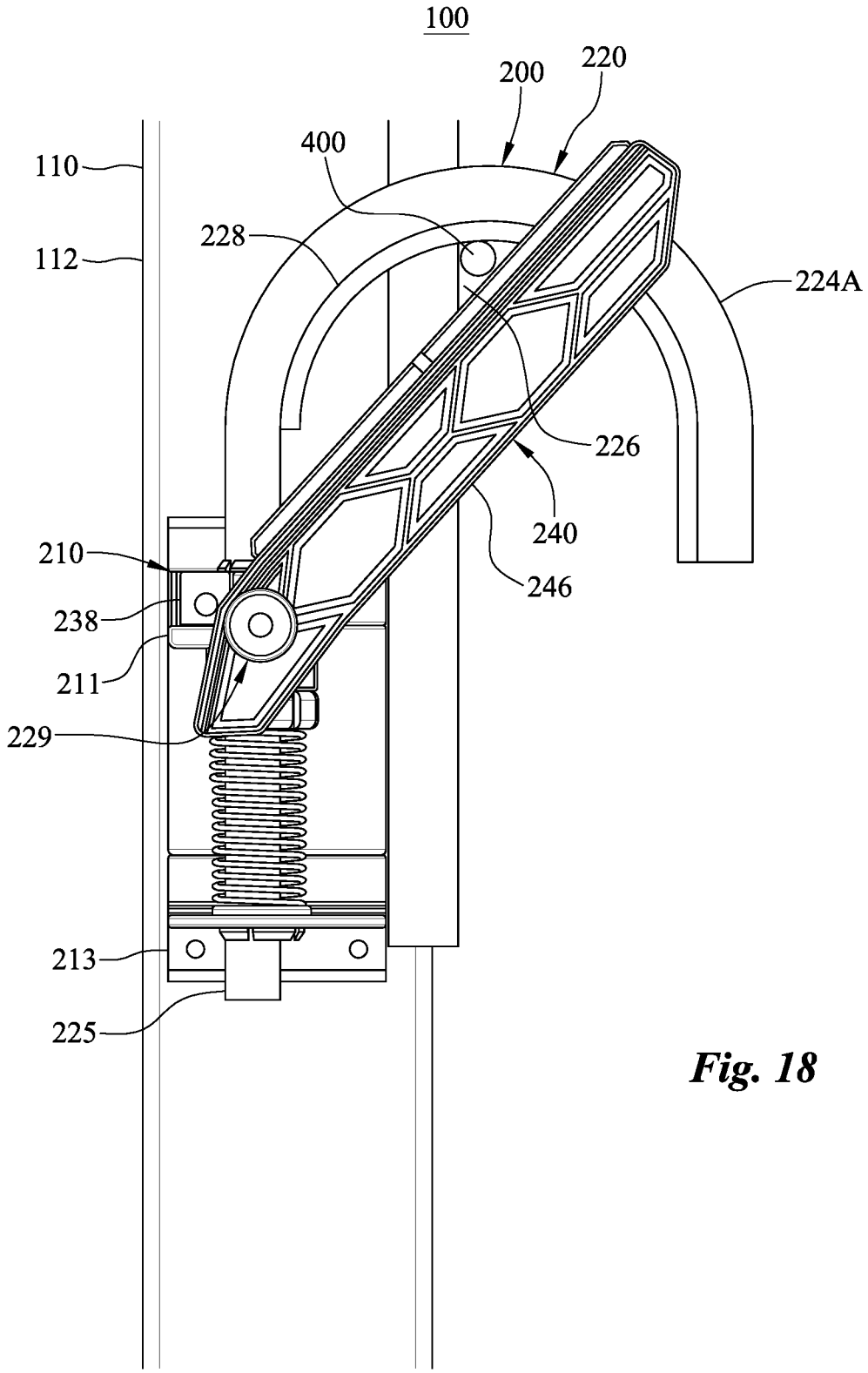
FIG. 18 is an exemplary detailing drawing illustrating still another alternative embodiment of the first safety apparatus of FIG. 15, wherein the first safety apparatus is in a closed position.

FIG. 17 shows the first safety apparatus 200 in an intermediate position during transition between the open position (shown in FIG. 15) and the closed position (shown in FIG. 18). The support member 229 slides toward the first bracket member 211 and enables the end region 248 to engage the first bracket member 211. Stated somewhat differently, the support member 229 slides toward the first bracket member 211 and enables the end region 248 to be pushed by the levering member 238 that extends from the first bracket member 211. Thus, the levering member 238 can rotate the cable trap body 246 from the open position to the closed position to capture the selected structure 400 within the hook mouth 226 between the hook 224 and the cable trap body 246.

As shown in FIG. 17, as the cable trap body 246 slides toward the first bracket member 211 during use, the support member 229 compresses the spring 252 (shown in FIG. 15) between the support member 229 and the first bracket member 211. The levering member 238 engages the cable trap body 246 to rotate the cable trap body 246 toward the hook 224. Stated somewhat differently, the selected structure 400, such as the safety cable, exerts a force to move the hook 224 relative to the first and second bracket members 211, 213. The support member 229 compresses the spring 252 and the first bracket member 211 engages the cable trap body 246 via the levering member 238.

FIG. 18 shows the first safety apparatus 200 in the closed position. As the support member 229 slides further toward the first bracket member 211 (in comparison with FIG. 17), the support member 229 can further compress the spring 252 (shown in FIG. 15) between the support member 229 and the first bracket member 211. The first bracket member 211 can engage the cable trap body 246 to transition the cable trap body 246 to the closed position to capture the selected structure 400 within the hook mouth 226. Stated somewhat differently, the first bracket member 211 can engage the cable trap body 246 via the levering member 238 to transition the cable trap body 246 to the closed position. The cable trap body 246 is shown as enclosing the hook mouth 226 in the closed position.

Figure 19:
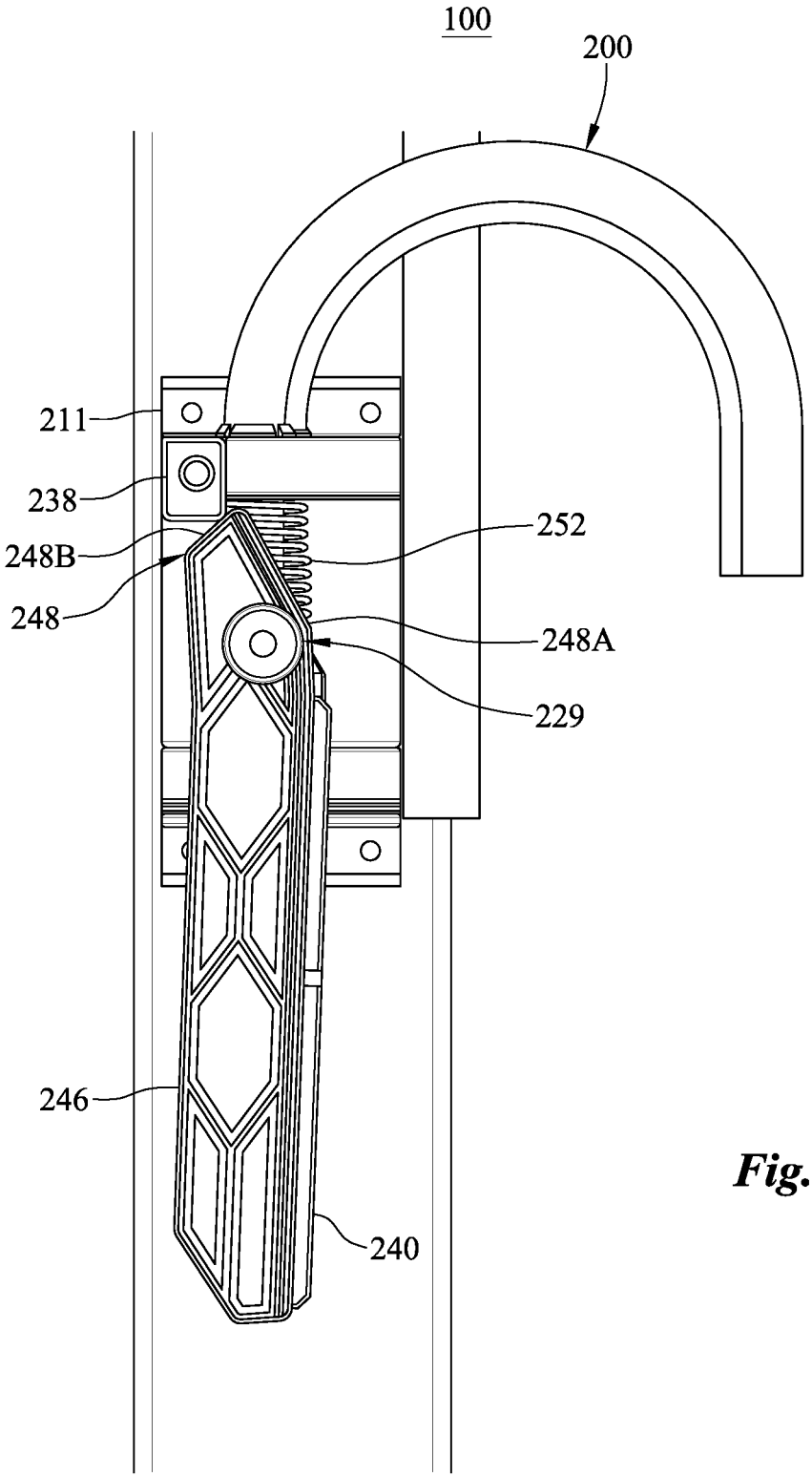
FIG. 19 is an exemplary detailing drawing illustrating still another alternative embodiment of the first safety apparatus of FIG. 15, wherein the first safety apparatus is in a lock position.

FIG. 19 shows the first safety apparatus 200 in a lock position. The end region 248 is shown as including first and second facets 248A, 248B abutting each other to form a ridge-shaped edge. The first and second facets 248A, 248B can be distal from and proximal to the levering member 238, respectively.

When the levering member 238 is in contact with the first facet 248A, the levering member 238 can enable transition of the cable trap body 246 from the open position (shown in FIG. 15) to the closed position (shown in FIG. 18). However, when the levering member 238 is in contact with the second facet 248B, the levering member 238 can inhibit pivoting of the cable trap body 246 from the open position to the closed position.

Stated somewhat differently, when the levering member 238 is in contact with the second facet 248B, the levering member 238 can stop the support member 229 from sliding toward the first bracket member 211 and/or block rotation of the cable trap body 246 even if the weight is applied to the ladder 100. Thus, the cable trap body 246 can be locked in the open position. As a result, when the ladder 100 is not in use, even if any weigh is applied to the ladder 100, the support member 229 does not compress the spring 252 and unnecessary compression of the spring 252 can be prevented. Advantageously, lifetime of the spring 252 and/or the first safety apparatus 200 can be extended and structure of the ladder 100 can be more sturdy and compact during handling and transportation.

Figure 20:
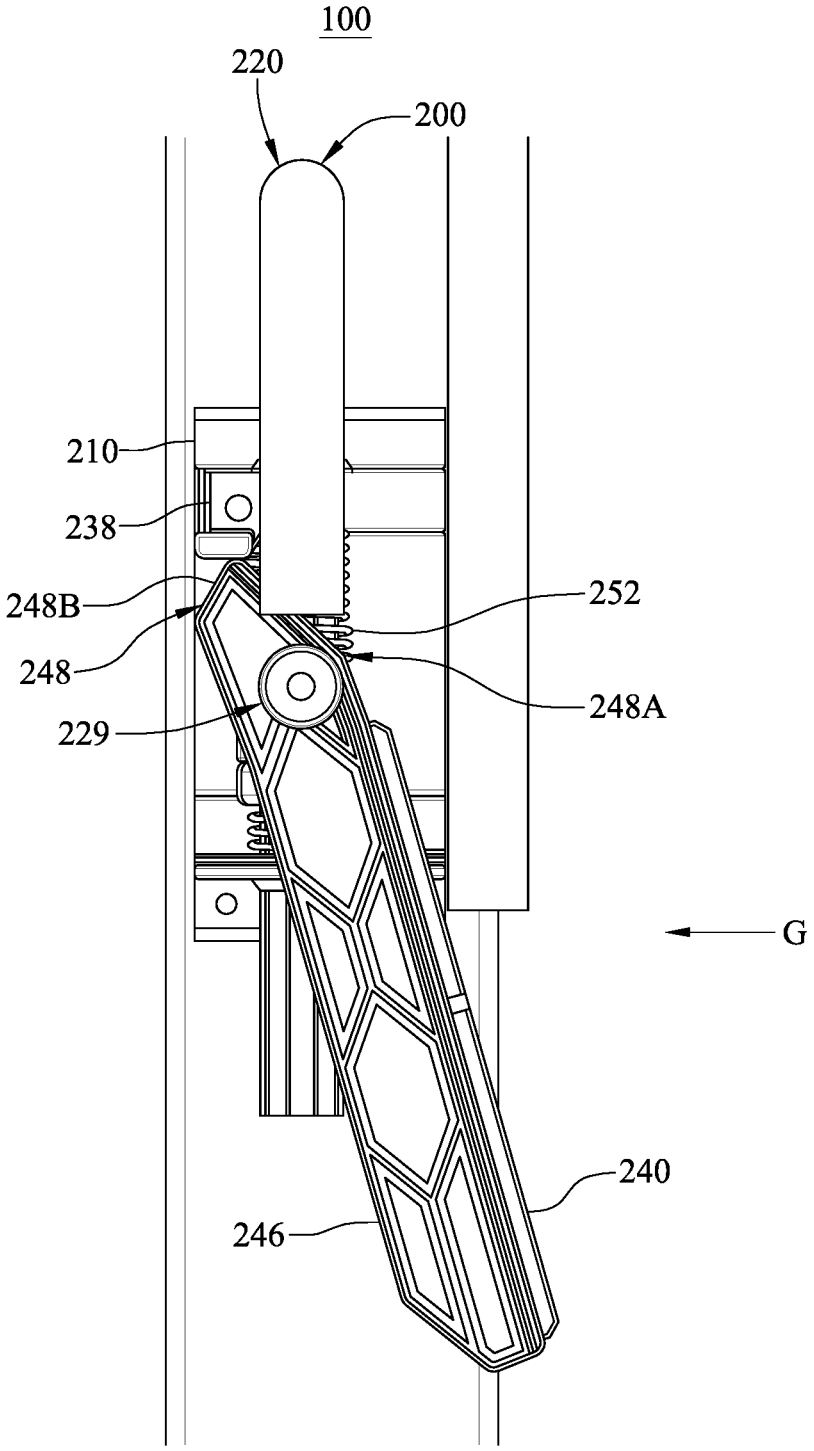
FIG. 20 is an exemplary detailing drawing illustrating still another alternative embodiment of the first safety apparatus of FIG. 15, wherein the first safety apparatus is in a plan parallel with rungs of the ladder.

FIG. 20 shows the first safety apparatus 200 in a storage position. The first safety apparatus 200 can be rotatably coupled with the first mounting bracket 210. Stated somewhat differently, at least part of the first safety apparatus 200 can rotate about the first mounting bracket 210. As illustrated in FIG. 20, the engagement member 220 can rotate into a plane parallel with the rungs 140 (shown in FIG. 1). When the first safety apparatus 200 is not in use, the engagement member 220 can rotate about the first mounting bracket 210 from the open position (shown in FIG. 15) by a selected angle. The exemplary angle shown in FIG. 20 is 90 degrees.

Although FIG. 20 shows the first safety apparatus 200 as being in the storage position only, the second safety apparatus 300 (shown in FIG. 1) can be rotatably coupled with the second mounting bracket 310 and can rotate into the plane parallel with the rungs 140 when the second safety apparatus 300 is not in use.

Advantageously, the storage position can place the first safety apparatus 200 in a frame of the ladder 100 to minimize potential inadvertent scraping, puncturing or catching on other surfaces when transporting and storing the ladder 100. Similarly, the placement of the engagement member 220 can help to cover or protect barbs, teeth, or other engaging features that can be formed on the engagement member 220.

Figure 21:
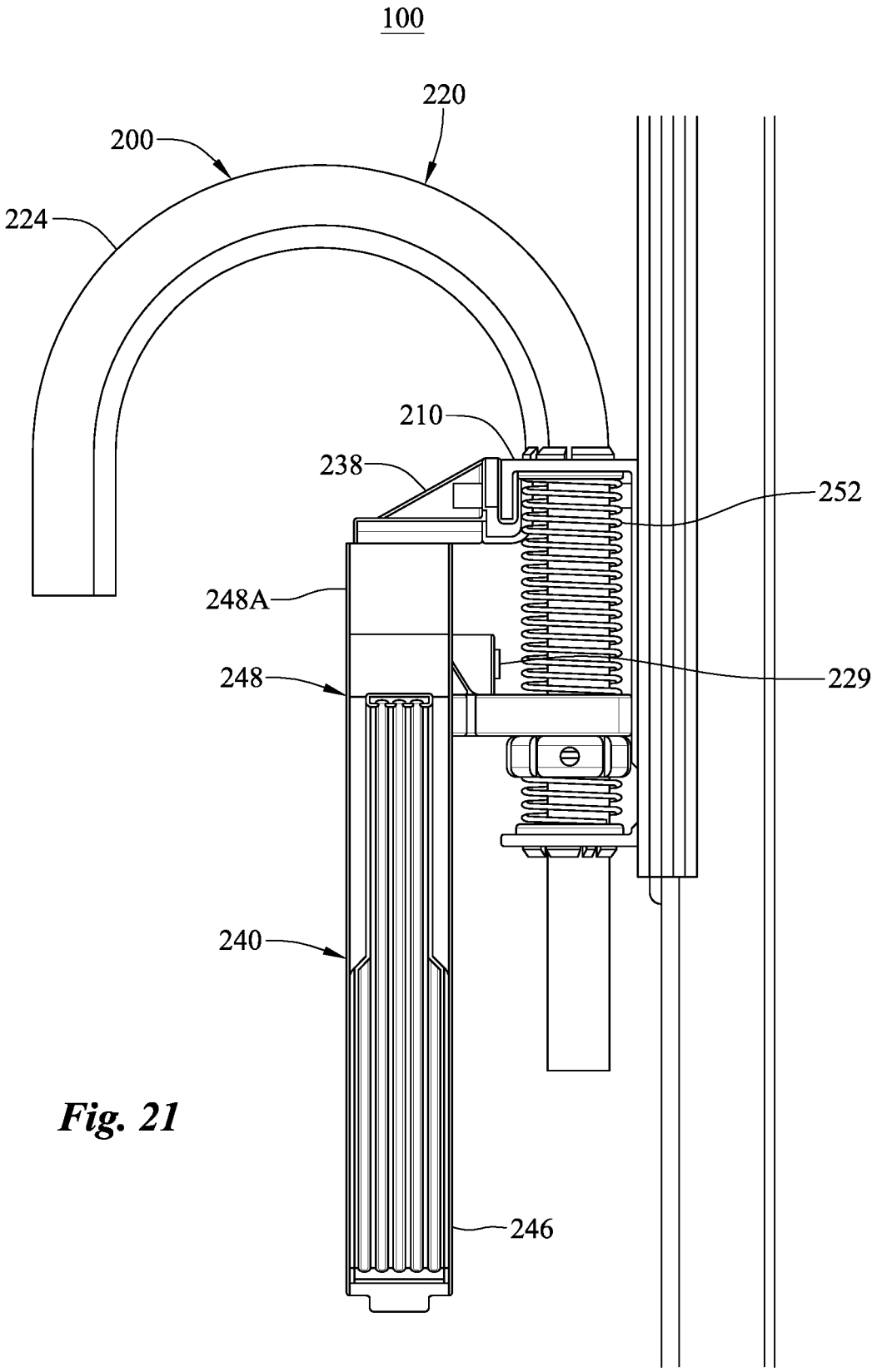
FIG. 21 is an exemplary detailing drawing illustrating an alternative embodiment of the first safety apparatus of FIG. 20, wherein the first safety apparatus is viewed in a direction perpendicular to a plane parallel with rungs of the ladder.

FIG. 21 shows the first safety apparatus 200 of FIG. 20 that is viewed in the direction G (shown in FIG. 20). FIG. 21 further illustrates the engagement member 220 as being in the plane parallel with the rungs 140 (shown in FIG. 1). The cable trap body 246 is shown as being in the open position without rotation about the first mounting bracket 210.

Although FIG. 21 shows the hook 224 as being rotatable about the first mounting bracket 210 only, additional and/or alternative parts fixedly coupled to the hook 224 can also rotate about the first mounting bracket 210, without limitation. In one example, the support member 229 and/or the cable trap body 246 can rotate about the first mounting bracket 210 and with the hook 224. In another example, the compressing member 232 (shown in FIG. 10) can rotate about the first mounting bracket 210.

The disclosed embodiments are susceptible to various modifications and alternative forms, and specific examples thereof have been shown by way of example in the drawings and are herein described in detail. It should be understood, however, that the disclosed embodiments are not to be limited to the particular forms or methods disclosed, but to the contrary, the disclosed embodiments are to cover all modifications, equivalents, and alternatives.

What is claimed is:

1. A ladder safety apparatus, comprising:

a ladder mounting bracket with a first bracket member defining a first bracket opening and a second bracket member defining a second bracket opening being axially aligned with the first bracket opening;

a cable hook with an arcuate hook region defining a hook mouth and a hook base region having an external hook base region periphery and a support member extending from the hook base region periphery, the hook base region being slidably disposed within the first and second bracket openings such that the arcuate hook region extends from the first bracket member and the support member is positioned between the first and second bracket members;

at least one spring being disposed about the hook base region periphery between the first bracket member and the support member and biasing the support member adjacent to the second bracket member; and a cable trap having a cable trap body with proximal and distal cable trap end regions and being pivotally coupled with the support member such that the distal cable trap end region extends distally from the arcuate hook region in an open position and encloses at least a part of the hook mouth in a closed position, wherein the support member slides toward the first bracket member and enables the proximal cable trap end region to engage the first bracket member and to rotate the cable trap body from the open position to the closed position to capture a safety cable within the hook mouth between the arcuate hook region and the cable trap body.

2. A ladder, comprising:

first and second side rails each having an upper side rail portion;

at least one cross-member coupling said first and second side rails; and first and second ladder safety apparatuses each in accordance with claim 1, the ladder mounting bracket of said first ladder safety apparatus coupling said first ladder safety apparatus with the upper side rail portion of said first side rail, the ladder mounting bracket of said second ladder safety apparatus coupling said second ladder safety apparatus with the upper side rail portion of said second side rail, wherein the first and second ladder safety apparatuses each transition to capture a safety cable as weight is added to a selected cross-member, and wherein the first and second ladder safety apparatuses each transition to release the safety cable as weight is removed from the selected cross-member.

3. A safety apparatus, comprising:

a mounting bracket for coupling with a side rail of a ladder;

an engagement member slidably engaging said mounting bracket and defining an engagement member recess for receiving a selected structure;

a retention member having an end region being rotatably coupled with said engagement member such that the retention member extends distally from said engagement member in an open position and the retention member extends proximally to said engagement member in a closed position; and a biasing system for biasing said engagement member and said retention member into the open position, wherein, when weight is applied to the ladder, said engagement member slides relative to said mounting bracket such that the retention member engages a levering member extending from said mounting bracket to rotate the retention member into the closed position, wherein said retention member transitions from the open position to the closed position for at least partially enclosing the selected structure within the engagement member recess when the weight is applied to the ladder, and wherein said retention member transitions from the closed position to the open position for at least partially releasing the selected structure when the weight is removed from the ladder.

4. The safety apparatus of claim 3, wherein an engagement of the selected structure between said engagement member and said retention member in the closed position progressively increases as additional weight is applied to the ladder.

5. The safety apparatus of claim 4, wherein the engagement of the selected structure by said engagement member and said retention member progressively decreases as the additional weight is removed from the ladder.

6. The safety apparatus of claim 4, wherein said retention member encloses the selected structure within the engagement member recess when the weight is applied to the ladder, and wherein said retention member releases the selected structure when the weight is removed from the ladder.

7. The safety apparatus of claim 5, wherein said engagement member comprises a hook defining a hook mouth, and wherein said retention member at least partially encloses the selected structure within the hook mouth when the weight is applied to the ladder.

8. The safety apparatus of claim 4, wherein said engagement member is at least partially lined with a non-skid surface material for securing an engagement between said engagement member and the selected structure.

9. The safety apparatus of claim 4, wherein said retention member and the side rail of the ladder define a retention member recess therebetween that cooperates with the engagement member recess such that the selected structure is enclosed within the retention member recess and the engagement member recess when said retention member is in the closed position.

10. The safety apparatus of claim 3, wherein said retention member is rotatably coupled with said engagement member via a support member extending from said engagement member, and wherein said biasing system comprises at least one spring being disposed between the support member and said mounting bracket and biasing said retention member distally from the engagement member recess of said engagement member.

11. The safety apparatus of claim 3, wherein said mounting bracket includes a first bracket member defining a first bracket opening and a second bracket member defining a second bracket opening being axially aligned with the first bracket opening, and wherein said engagement member is at least partially disposed within the first and second bracket openings and extends from the first and second bracket members.

12. The safety apparatus of claim 11, wherein an engagement member portion of said engagement member that defines the engagement member recess extends from the first bracket member by a first predetermined distance.

13. The safety apparatus of claim 12, wherein, in response to the weight being applied to the ladder, said engagement member slides within the first and second bracket openings, and the engagement member portion extends from the first bracket member by a second predetermined distance that is greater than the first predetermined distance.

14. A ladder, comprising:

first and second side rails each having an upper side rail portion with an upper end region;

a plurality of rungs coupling said first and second side rails; and first and second safety apparatuses each in accordance with claim 3, said mounting bracket of said first safety apparatus coupling said first safety apparatus with the upper side rail portion of said first side rail at a first predetermined distance from the upper end region of said first side rail, said mounting bracket of said second safety apparatus coupling said second safety apparatus with the upper side rail portion of said second side rail at a second predetermined distance from the upper end region of said second side rail being equal to the first predetermined distance, wherein an engagement of a selected structure by said first and second safety apparatuses increases as weight is added to the ladder, and wherein the engagement of the selected structure by said first and second safety apparatuses decreases as the weight is removed from the ladder.

15. The ladder of claim 14, wherein the engagement member of said first safety apparatus is rotatably coupled with the mounting bracket of the first safety apparatus, and can rotate into a plane parallel with the rungs.

16. The ladder of claim 14, wherein the upper side rail portions of said first and second side rails are at least partially lined with a non-skid surface material for securing the engagement with the selected structure.

* * * * *